US005112733A

United States Patent [19]

Ihama

[11] Patent Number: 5,112,733

[45] Date of Patent: May 12, 1992

[54] SILVER HALIDE PHOTOGRAPHIC EMULSION

[75] Inventor: Mikio Ihama, Minami-Ashigara, Japan

[73] Assignee: Fuji Photo Film Co., Ltd., Kanagawa, Japan

[21] Appl. No.: 531,310

[22] Filed: May 31, 1990

[30] Foreign Application Priority Data

May 31, 1989 [JP] Japan ..... 1-138940

[51] Int. Cl.[5] ..... G03C 1/09

[52] U.S. Cl. ..... 430/603; 430/569; 430/605

[58] Field of Search ..... 430/603, 604, 605, 569

[56] References Cited

U.S. PATENT DOCUMENTS 2,448,060 7/1946 Smith et al. ..... 430/604
2,540,086 6/1948 Baldsiefen et al. ..... 430/603
3,297,446 1/1967 Dunn .
3,420,670 1/1969 Milton ..... 430/605
4,092,171 5/1978 Bigelow ..... 430/605

FOREIGN PATENT DOCUMENTS 231431 12/1985 German Democratic Rep. .
60-151637 8/1985 Japan .

*Primary Examiner*—Charles L. Bowers, Jr.
*Assistant Examiner*—Janet C. Baxter
*Attorney, Agent, or Firm*—Birch, Stewart, Kolasch & Birch

[57] ABSTRACT

The present invention relates to a silver halide emulsion subjected to selenium sensitization in the presence of a palladium compound in an amount of $5\times10^{-5}$ mol or more per mol of a silver halide. In addition to selenium sensitization, the emulsion may be subjected to sulfur sensitization and/or gold sensitization. In a process of manufacturing the silver halide emulsion, the palladium compound is preferably added to the emulsion before chemical sensitization.

12 Claims, No Drawings

SILVER HALIDE PHOTOGRAPHIC EMULSION

BACKGROUND OF THE INVENTION

1. Field of the Invention

The present invention relates to a silver halide photographic emulsion.

2. Description of the Related Art

U.S. Pat. No. 3,297,446 discloses a photographic silver halide emulsion sensitized by at least two different sensitizers, i.e., a noble metal sensitizer and an labile selenium sensitizer. A gold sensitizer, a platinum sensitizer and a palladium sensitizer are exemplified as the noble metal sensitizer, and the use amount of the palladium sensitizer is about $10^{-6}$ mol per mol of silver.

JP-B-52-34492 ("JP-B-" means Examined Published Japanese Patent Application) discloses a silver halide photographic emulsion preparation method characterized in that a silver potential is set to be 100 mV or more and/or the pH is set to be 7.5 or more upon addition of a noble metal sensitizer and a non-labile selenium compound, thereby performing sensitization. A gold sensitizer, a platinum sensitizer, and a palladium sensitizer are exemplified as the noble metal sensitizer, and the amount of the palladium sensitizer used is about $10^{-6}$ mol per mol of silver.

Each of JP-B-52-34491, JP-B-53-295, JP-B-52-36009, JP B-52-38408, and JP-A-60-151637 ("JP-A-" means Unexamined Published Japanese Patent Application) discloses a method for performing sensitization by using a noble metal sensitizer and a selenium sensitizer or an emulsion sensitized by the method. In each application, the use amount of a palladium sensitizer as the noble metal sensitizer is about $10^{-6}$ mol per mol of silver.

However, the above described emulsions or emulsions obtained by the above described methods have not enough sensitivity and are unstable.

SUMMARY OF THE INVENTION

It is an object of the present invention to provide a high-sensitivity emulsion subjected to selenium sensitization.

It is another object of the present invention to provide a selenium-sensitized and stabilized emulsion which produces only low fog.

The above objects of the present invention are achieved by the following emulsions.

(1) A silver halide photographic emulsion subjected to selenium sensitization in the presence of a palladium compound in an amount of $5\times10^{-5}$ mol or more per mol of a silver halide.

(2) A silver halide photographic emulsion subjected to selenium sensitization and sulfur sensitization in the presence of a palladium compound in an amount of $5\times10^{-5}$ mol or more per mol of a silver halide.

(3) A silver halide photographic emulsion subjected to selenium sensitization and gold sensitization in the presence of a palladium compound in an amount of $5\times10^{-5}$ mol or more per mol of a silver halide.

(4) A silver halide photographic emulsion subjected to selenium sensitization, sulfur sensitization and gold sensitization in the presence of a palladium compound in an amount of $5\times10^{-5}$ mol or more per mol of a silver halide.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

A silver halide emulsion of the present invention is subjected to selenium sensitization in the presence of a palladium compound in an amount of $5\times10^{-5}$ mol or more per mol of a silver halide. More preferably, the silver halide emulsion is subjected to selenium sensitization in the presence of $1\times10^{-4}$ mol or more of a palladium compound. The upper limit of the amount of a palladium compound is $5\times10^{-3}$ mol. More preferably, the silver halide emulsion is subjected to selenium sensitization in the presence of $10^{-3}$ mol or less of a palladium compound.

In this case, the palladium compound means a palladium divalent or tetravalent salt. The palladium compound is preferably represented by $R_2PdX_6$ or $R_2PdX_4$ wherein R represents a hydrogen atom, an alkali metal atom, or an ammonium group, and X represents a halogen atom, i.e., a chlorine, bromine, or iodine atom.

More specifically, examples of the palladium compound are $K_2PdCl_4$, $(NH_4)_2PdCl_6$, $Na_2PdCl_4$, $(NH_4)_2PdCl_4$, $Li_2PdCl_4$, $Na_2PdCl_6$, and $K_2PdBr_4$.

Other examples are $PdCl_2$, $PdBr_2$, $PdI_2$, $Pd(NO_3)_2$, $PdSO_4$, $Pd(OH)_2$, PdO, $Pd(NH_3)_4Cl_2$, $Pd(NH_3)_4(NO_3)_2$, $PdCl_2(NH_3)_2$, $Pd(NO_2)_2(NH_3)_2$, $Na_2Pd(NO_2)_4$, $K_2Pd(CN)_4$, $K_2Pd(NO_2)_2SO_4$, $Pd(CH_3COO)_2$, $Pd(C_2H_5COO)_2$, $Pd(C_6H_5COO)_2$, $PdCl_2(C_6H_5CN)_2$, $PdCl_2(C_8H_{12})$, $PdCl_2(C_7H_8)$, $PdCl_2(PPh_3)_2)$, $PdCl_2(C_3H_5)_2$, $Pd(acac)_2$, $Pd(C_{17}H_{34}O)_2$, $Pd(CH_3COO)_2(PPh_3)_2$, and $Pd(PPh_3)_4$. Of these examples, a water-soluble palladium compound is preferred. Most preferably, the palladium compound is used in combination with thiocyanate ions in an amount (mol) five times or more that of the palladium compound.

"Selenium sensitization is performed in the presence of a palladium compound" means that the palladium compound is added to an emulsion to be chemically sensitized before the emulsion is chemically sensitized. Generally, a process of manufacturing a silver halide emulsion is roughly divided into, e.g., a grain formation step, a desalting step, a chemical sensitization step, and a coating step. The grain formation step is subdivided into, e.g., nucleation, ripening, and precipitation. The palladium compound is added during chemical sensitization or after grain formation and before desalting. Most preferably, the palladium compound is added after grain formation and before desalting. "The palladium compound is added after grain formation and before desalting" means that the palladium compound is added during a period from the end of addition of a silver salt solution during grain formation to the start of desalting. That is, the palladium compound may be added simultaneously with the end of addition of the silver salt solution or at any arbitrary time from the end of addition of the silver salt solution to the start of desalting. The total amount of the palladium compound can be added at the same time, or the compound can be added in parts or continuously added over a predetermined period of time. A silver halide emulsion may be ripened or left to stand at a high temperature for a long time period from the end of addition of the palladium compound to desalting. It is also preferred to add only a portion of the palladium compound after grain formation and before desalting and add the rest during chemical sensitization.

Other conditions of the paladium compound are arbitrary in conventionally utilized conditions. That is, the temperature may be 30° C. to 80° C., and preferably, 40° C. to 70° C. The pH and the pAg may be arbitrary values. The pH is preferably 4 to 10.

An emulsion of the present invention is subjected to selenium-sensitization in the presence of the palladium compound in an amount of $5\times10^{-5}$ mol or more per mol of a silver halide. Selenium sensitization is performed by a conventionally known method. That is, selenium sensitization is performed by adding a labile selenium compound and/or a non-labile selenium compound and stirring an emulsion at a high temperature of preferably 40° C. or more for a predetermined time period. Selenium sensitization using an labile selenium sensitizer described in JP-B-44-15748 is preferably used. Examples of the labile selenium sensitizer are aliphatic isoselenocyanates such as allylisoselenocyanate, selenourea or its derivatives, selenoketones, selenoamides, selenocarboxylic acids or their ester, and a selenophosphate. Most preferable labile selenium compounds are as follows.

I. Colloidal metal selenium

II. Organic selenium compound (in which a selenium atom is double-bonded to a carbon atom of an organic compound by covalent bonding)

a. Isoselenocyanates: An example is an aliphatic isoselenocyanate such as allylisoselenocyanate.

b. Selenourea derivatives (including an enol form): Examples are an aliphatic selenourea such as methyl, ethyl, propyl, isopropyl, butyl, hexyl, octyl, dioctyl, tetramethyl, N-(β-carboxyethyl)-N',N'-dimethyl, N,N-dimethyl, diethyl, and dimethyl; an aromatic selenourea having one or more aromatic groups such as phenyl and tolyl; and a heterocyclic selenourea having a heterocyclic group such as pyridyl and benzothiazolyl.

c. Selenoketones: Examples are selenoacetone, selenoacetophenone, selenoketones in which an alkyl group is bonded to >C=Se, and selenobenzophenone.

d. Selenoamides: An example is selenoacetoamide.

e. Selenocarboxylic acids and their ester: Examples are 2-selenopropionic acid, 3-selenobutyric acid, and methyl 3-selenobutyrate.

III. Others a. Selenides: Examples are diethylselenide, diethyldiselenide, and triphenylphosphineselenide.

b. Selenophosphates: Examples are tri-p-tolylselenophosphate and tri-n-butylselenophosphate.

Although preferable examples of the labile selenium compound are enumerated above, the labile selenium compound is not limited to the above examples. Those skilled in the art generally understand that a structure of the labile selenium compound as a sensitizer of a photographic emulsion is not important as long as selenium is labile and that an organic portion of the selenium compound molecule does nothing but carries selenium and allows it to exist in a labile state in the emulsion. In the present invention, the labile selenium compound is advantageously used within the above wide range of concept.

Selenium sensitization is also performed by using non-labile selenium sensitizers described in JP-B-46-4553, JP-B-52-34492, and JP-B-52-34491. Examples of the non-labile selenium compound are selenious acid, potassium selenocyanate, selenazoles, quaternary ammonium salts of selenazoles, diarylselenide, diaryldiselenide, 2-thioselenazolidinedion, 2-selenoxazolidinethion, and their derivatives.

A non-labile selenium sensitizer and a thioselenazolidinedion compound described in JP-B-52-38408 are also effective.

These selenium sensitizers are dissolved in water, an organic solvent such as methanol or ethanol, or a mixture thereof and the solution is added upon chemical sensitization. Preferably, the selenium sensitizers are added before chemical sensitization is started. The selenium sensitizers can be used singly or in a combination of two or more types thereof. A combination of a labile selenium compound and a non-labile selenium compound is preferable.

Although an addition amount of the selenium sensitizer used in the present invention depends on, e.g., the activity of a selenium sensitizer to be used, the type or size of a silver halide, and the temperature and the time of ripening, it is preferably $1\times10^{-8}$ mol or more, and more preferably, $1\times10^{-7}$ mol to $1\times10^{-5}$ mol per mol of a silver halide. When a selenium sensitizer is used, the temperature of chemical ripening is preferably 45° C. or more, and more preferably, 50° C. to 80° C. The pAg and the pH are arbitrary. For example, the effects of the present invention can be obtained throughout a wide pH range of 4 to 9.

Selenium sensitization performed in the presence of a palladium compound in an amount of $5\times10^{-5}$ mol or more per mol of a silver halide can be performed more effectively in the presence of a silver halide solvent.

Examples of a silver halide solvent which can be used in the present invention are (a) organic thioethers described in, e.g., U.S. Pat. Nos. 3,271,157, 3,531,289, and 3,574,628, JP-A-54-1019, and JP-A-54-158917; (b) thiourea derivatives described in, e.g., JP-A-53-82408, JP-A-55-77737, and JP-A-55-2982; (c) a silver halide solvent having a thiocarbonyl group sandwiched between an oxygen or sulfur atom and a nitrogen atom described in JP-A-53-144319; (d) an imidazole derivative described in JP-A-54-100717; (e) a sulfite; and (f) thiocyanate.

Examples of the above compound are listed in Table 6 to be presented later.

Most preferable solvents are thiocyanate and tetramethylthiourea. The amount of the solvent to be used depends on the type of solvent. For example, a preferable amount of thiocyanate is $1\times10^{-4}$ mol to $1\times10^{-2}$ mol per mol of a silver halide.

In the silver halide photographic emulsion of the present invention, higher sensitivity and lower fog can be achieved by additionally performing sulfur sensitization and/or gold sensitization in chemical sensitization.

Sulfur sensitization is normally performed by adding a sulfur sensitizer to an emulsion and stirring the emulsion at a high temperature of preferably 40° C. or more for a predetermined time period.

Gold sensitization is normally performed by adding a gold sensitizer to an emulsion and stirring the emulsion at a high temperature of 40° C. or more for a predetermined time period.

A known sulfur sensitizer can be used in sulfur sensitization. Examples of the sulfur sensitizer are thiosulfate, allylthiocarbamidethiourea, allylisothiacyanate, cystine, p-toluenethiosulfonate, and rhodanine. Other examples of the sulfur sensitizer are described in, e.g., U.S. Pat. Nos. 1,574,944, 2,410,689, 2,278,947, 2,728,668, 3,501,313, and 3,656,955, West German Patent 1,422,869, JP-B-56-24937, and JP-A-55-45016. An addition amount of the sulfur sensitizer need only be an amount sufficient to increase the sensitivity of an emulsion. Although this amount changes throughout a wide range in accordance with various conditions, e.g., the pH, the temperature, and the size of silver halide grains, it is preferably $1\times10^{-7}$ to $5\times10^{-5}$ mol per mol of a silver halide.

As a gold sensitizer for use in gold sensitization, any gold compound which has an oxidation number of gold of +1 or +3 and is normally used as a gold sensitizer can be used. Typical examples of the gold sensitizer are chloroaurate, potassium chloroaurate, auric trichloride, potassium auric thiocyanate, potassium iodoaurate, tetracyanoauric acid, ammonium aurothiocyanate, and pyridyltrichloro gold.

Although an addition amount of the gold sensitizer depends on various conditions, it is preferably $1\times10^{-7}$ to $5\times10^{-5}$ mol per mol of a silver halide.

Upon chemical ripening, addition timings and an addition order of a silver halide solvent and a selenium sensitizer or a sulfur sensitizer and/or a gold sensitizer which can be used in combination with the selenium sensitizer are not particularly limited. For example, the above compounds can be added at an initial stage of chemical ripening or (preferably) during chemical ripening either simultaneously or different timings. Upon addition, the above compounds are dissolved in water, an organic solvent such as methanol, ethanol, or acetone which is miscible with water, or a mixture thereof and added.

The silver halide emulsion of the present invention is preferably subjected to reduction sensitization during grain formation.

"Reduction sensitization is performed during grain formation of the silver halide emulsion" means that reduction sensitization is performed during nucleation, ripening, or precipitation. Reduction sensitization can be performed at any timing of nucleation which is an initial stage of grain formation, physical ripening, and precipitation. Most preferably, reduction sensitization is performed during precipitation of silver halide grains. In this case, "reduction sensitization performed during precipitation" includes a method of performing reduction sensitization while silver halide grains are being precipitated due to physical ripening or addition of a water-soluble silver salt and a water-soluble alkali halide and a method of performing reduction sensitization in the state wherein the precipitation of the grains is temporarily suspended thereafter resuming the precipitation.

Reduction sensitization can be performed by any of a method of adding a known reduction sensitizer to a silver halide emulsion, a method called silver ripening in which precipitation or ripening is performed in a low pAg atmosphere of a pAg of 1 to 7, and a method called high-pH ripening in which precipitation or ripening is performed in a high-pH atmosphere of a pH of 8 to 11. These methods can be used in a combination of two or more thereof.

A method of adding a reduction sensitizer is preferable since the level of reduction sensitization can be finely adjusted.

Known examples of the reduction sensitizer are stannous chloride, amines and polyamines, hydrazine derivatives, formamidine sulfinic acid, silane compounds, and borane compounds. In the present invention, these known compounds can be selectively used or used in a combination of two or more thereof. As the reduction sensitizer, stannous chloride, thiourea dioxide, dimethylaminoborane, ascorbic acid, ascorbic acid derivatives are preferable compounds. Although an addition amount must be selected in accordance with the emulsion manufacturing conditions, it is preferably $10^{-8}$ to $10^{-3}$ mol per mol of a silver halide.

The reduction sensitizer can be dissolved in a solvent such as alcohols, glycols, ketones, esters, and amides and added during grain formation. Although the reduction sensitizer can be added in a reaction vessel beforehand, it is preferably added at an arbitrary timing during grain formation. In addition, the reduction sensitizer may be added in an aqueous solution of a water-soluble silver salt or a water-soluble alkali halide, which is utilized for grain formation. Furthermore, a solution of the reduction sensitizer may be added a plurality of times or continuously added during grain formation.

The silver halide emulsion of the present invention is preferably subjected to spectral sensitization and used.

A methine dye is normally used as a spectral sensitizing dye for use in the present invention. The methine dye includes a cyanine dye, a merocyanine dye, a complex cyanine dye, a composite merocyanine dye, a holopolar cyanine dye, a hemicyanine dye, a styryl dye, and a hemioxonole dye. Any nucleus normally used as a basic heterocyclic nucleus in a cyanine dye can be applied to these dyes. Examples of the nucleus are pyrroline, oxazoline, thiazoline, pyrrole, oxazole, thiazole, selenazole, imidazole, tetrazole, and pyridine; nuclei in which an allcyclic hydrocarbon ring is condensed to these nuclei; and nuclei in which an aromatic hydrocarbon ring is condensed to these nuclei, i.e., indolenine, benzndolenine, indole, benzoxazole, naphthoxazole, benzothiazole, naphthothiazole, benzoselenazole, benzimidazole, and quinoline. These nuclei may be substituted on a carbon atom.

Examples of a nucleus having a ketomethylene structure, which can be applied to a merocyanine dye or a composite merocyanine dye, are 5- or 6-membered heterocyclic nuclei such as pyrazoline-5-one, thiohydantoin, 2-thiooxazolidine-2,4-dione, thiazolidine-2,4-dione, rhodanine, and thiobarbituric acid.

Of the above dyes, a cyanine dye is a most effective sensitizing dye in the present invention. An example of a cyanine dye effective in the present invention is a dye represented by the following general formula (I).

General Formula (I)

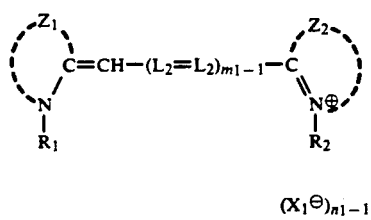

In general formula (I), each of $Z_1$ and $Z_2$ independently represents a heterocyclic nucleus normally used in a cyanine dye, and particularly, an atom group required to complete thiazole, thiazoline, benzothiazole, naphthothiazole, oxazole, oxazoline, benzoxazole, naphthoxazole, tetrazole, pyridine, quinoline, imidazoline, imidazole, benzimidazole, naphthimidazole, selenazoline, selenazole, benzoselenazole, naphthoselenazole, or indolenine. These nuclei may be substituted by a lower alkyl group such as methyl, a halogen atom, a phenyl group, a hydroxyl group, an alkoxy group having 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, and a nitro group.

Each of $L_1$ and $L_2$ independently represents a methine group or a substituted methine group. Examples of the substituted methine group are methine groups substituted by a lower alkyl group such as methyl and ethyl, phenyl, substituted phenyl, methoxy, and ethoxy.

Each of $R_1$ and $R_2$ independently represents a alkyl group having 1 to 5 carbon atoms; a substituted alkyl group having a carboxyl group; a substituted alkyl group having a sulfo group such as β-sulfoethyl, γ-sulfopropyl, δ-sulfobutyl, 2-(3-sulfopropoxy)ethyl, 2-[2-(3-sulfopropoxy)ethoxy]ethyl, or 2-hydroxysulfopropyl; an allyl group, and substituted alkyl group normally used as an N-substituent of a cyanine dye.

$m_1$ represents 1 2 or 3.

$X_1^{\ominus}$ represents an iodine ion, a bromine ion or an acid anion, such as a p-toluenesulfonate ion and a perchloride ion, which are normally used in a cyanine dye.

$n_1$ represents 1 or 2. If the dye represented by general formula (I) has a betaine structure, $n_1$ is 1.

Typical compounds of most effective spectral sensitizing dyes for use in the present invention are listed in Table 7 to be presented later.

In addition to the compounds listed in Table 7, the following compounds can be used as the spectral sensitizing dye. That is, examples of the compound are those described in, e.g., West German Patent 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, and 4,026,707, British Patents 1,242,588, 1,344,281, and 1,507,803, JP-B-44-14,030, JP-B-52-24,844, JP-B-43-4936, JP-B-53-12,375, JP-A-52-110,618, JP-A-52-109,925, and JP-A-50-80,827.

Although an amount of the sensitizing dye to be added during preparation of a silver halide emulsion cannot be uniquely determined since it depends on the type of additive or an amount of a silver halide, substantially the same amount as that added in conventional methods can be used.

That is, the addition amount of the sensitizing dye is preferably 0.001 to 100 mmol, and more preferably, 0.01 to 10 mmol per mol of a silver halide.

The sensitizing dye is added before or after chemical ripening. Upon silver halide grains of the present invention, the sensitizing dye is most preferably added during or before chemical ripening (e.g., during grain formation or physical ripening).

The emulsion may contain, in addition to the sensitizing dye, a dye having no spectral sensitizing effect or a substance which essentially does not absorb visible light and has a supersensitizing effect. For example, the emulsion may contain an aminostyryl compound substituted by a nitrogen-containing heterocyclic group (described in, e.g., U.S. Pat. No. 2,933,390 or 3,635,721), an aromatic organic acid-formaldehyde condensation product (described in, e.g., U.S. Pat. No. 3,743,510), a cadmium salt, and an azaindene compound. Combinations described in U.S. Pat. Nos. 3,615,613, 3,615,641, 3,617,295, and 3,635,721 are most effective.

The photographic emulsion of the present invention may contain various types of compounds in order to prevent fog or to stabilize photographic properties during manufacturing, storage, or photographic processes of the light-sensitive material. That is, the emulsion may contain various types of compounds each known as an antifoggant or a stabilizer, e.g., an azole such as a benzothiazolium salt, a nitroindazole, a triazole, a benzotriazole, and a benzimidazole (particularly, a nitro or halogen substituent); a heterocyclic mercapto compound such as a mercaptothiazole, a mercaptobenzothiazole, a mercaptobenzimidazole, a mercaptothiadiazole, a mercaptotetrazole (particularly 1-phenyl-5-mercaptotetrazole), and a mercaptopyrimidine; the heterocyclic mercapto compound described above having a water-soluble group such as a carboxyl group or a sulfone group; a thioketo compound such as oxazolinethione; an azaindene such as a tetraazaindene (particularly a 4-hydroxy-substituted (1,3,3a,7)tetraazaindende); a benzenethiosulfonic acid; and benzenesulfinic acid.

These antifoggants or stabilizers are normally added after chemical sensitization is performed, and more preferably, added during or before chemical ripening. That is, in a silver halide emulsion grain formation process, these compounds can be added during addition of a silver salt solution, during a time period from the end of addition of the silver salt solution to start of chemical ripening, or during chemical ripening (before preferably 50%, and more preferably, 20% of a chemical ripening time is consumed from the start of chemical ripening).

More specifically, examples of the compound are a hydroxyazaindene compound, a benzotriazole compound, and a heterocyclic compound substituted by at least one mercapto group and having at least two azanitrogen atoms in its molecule.

A preferable example of the hydroxyazaindene compound is represented by the following general formula (II) or (III):

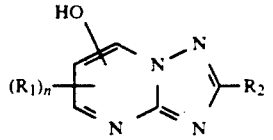

General Formula (II)

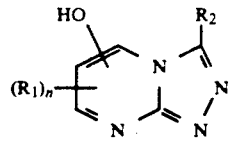

General Formula (III)

wherein $R_1$ and $R_2$ may be the same or different and independently represent a hydrogen atom; an aliphatic moiety [an alkyl group (e.g., methyl, ethyl, propyl, pentyl, hexyl, octyl, isopropyl, sec-butyl, t-butyl, cyclohexyl, cyclopentylmethyl, and 2-norbornyl); an alkyl group substituted by an aromatic moiety (e.g., benzyl, phenethyl, benzhydryl, 1-naphthylmethyl, and 3-phenylbutyl); an alkyl group substituted by an alkoxy group (e.g., methoxymethyl, 2-methoxyethyl, 3-ethoxypropyl, and 4-methoxybutyl); an alkyl group substituted by a hydroxyl group, a carbonyl group, or an alkoxycarbonyl group (e.g., hydroxymethyl, 2-hydroxymethyl, 3-hydroxybutyl, carboxymethyl, 2-carboxyethyl, and 2-(methoxycarbonyl)ethyl] or an aromatic moiety [aryl group (e.g., phenyl and 1-naphthyl); an aryl group having substituents (e.g., p-tolyl, m-ethylphenyl, m-cumenyl, mesityl, 2,3-xylyl, p-chlorophenyl, o-bromophenyl, p-hydroxyphenyl, 1-hydroxy-2-naphthyl, m-methoxyphenyl, p-ethoxyphenyl, p-carboxyphenyl, o-(methoxycarbonyl)phenyl, m-(ethoxycarbonyl)-phenyl, and 4-carboxy-1-naphthyl], hereby, a total number of carbon atoms of $R_1$ and $R_2$ is preferably 12 or less, and n represents 1 or 2.

Examples of a hydroxytetraazaindene compound represented by general formula (II) or (III) are presented below. Note that a compound which can be used in the present invention is not limited to these compounds.

II-1: 4-hydroxy-6-methyl-1,3,3a,7-tetraazaindene
II-2: 4-hydroxy-1,3,3a,7-tetraazaindene
II-3: 4-hydroxy-6-methyl-1,2,3a,7-tetraazaindene
II-4: 4-hydroxy-6-phenyl-1,3,3a,7-tetraazaindene
II-5: 4-methyl-6-hydroxy-1,3,3a,7-tetraazaindene
II-6: 2,6-dimethyl-4-hydroxy-1,3,3a,7-tetraazaindene
II-7: 4-hydroxy-5-ethyl-6-methyl-1,3,3a,7-tetraazaindene
II-8: 2,6-dimethyl-4-hydroxy-5-ethyl-1,3,3a,7-tetraazaindene
II-9: 4-hydroxy-5,6-dimethyl-1,3,3a,7-tetraazaindene
II-10: 2,5,6-trimethyl-4-hydroxy-1,3,3a,7-tetraazaindene
II-11: 2-methyl-4-hydroxy-6-phenyl-1,3,3a,7-tetraazaindene
II-12: 4-hydroxy-6-ethyl-1,2,3a,7-tetraazaindene
II-13: 4-hydroxy-6-phenyl-1,2,3a,7-tetraazaindene
II-14: 4-hydroxy-1,2,3a,7-tetraazaindene
II-15: 4-methyl-6-hydroxy-1,2,3a,7-tetraazaindene
II-16: 5,6-trimethylene-4-hydroxy-1,3,3a,7-tetraazaindene An example of a benzotriazole compound is a compound represented by the following general formula (IV):

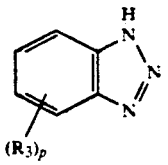

General Formula (IV)

wherein p represents 0 or an integer from 1 to 4, and $R_3$ represents a halogen atom (chlorine, bromine, or iodine) or an aliphatic group (including a saturated aliphatic group and a nonsaturated aliphatic group), e.g., a unsubstituted alkyl group having preferably 1 to 8 carbon atoms (e.g., methyl, ethyl, n-propyl, and hexyl); a substituted alkyl group (the number of carbon atoms of an alkyl radical (moiety) is preferably 1 to 4), e.g., a vinylmethyl group, an aralkyl group (e.g., benzyl and phenethyl), a hydroxyalkyl group (e.g., 2-hydroxyethyl, 3-hydroxypropyl, and 4-hydroxybutyl), an acetoxyalkyl group (e.g., 2-acetoxyethyl and 3-acetoxypropyl), an alkoxyalkyl group (e.g., 2-methoxyethyl and 4-methoxybutyl); or an aryl group (e.g., phenyl). More preferably, $R_3$ represents a halogen atom (chlorine or iodine) or an alkyl group having 1 to 3 carbon atoms (methyl, ethyl, or propyl).

Examples of the benzotriazole compound for use in the photographic emulsion of the present invention are presented below. The benzotriazole compound, however, is not limited to the following compounds.

Compound IV-1: Benzotriazole
Compound IV-2: 5-methyl-benzotriazole
Compound IV-3: 5,6-dimethylbenzotriazole
Compound IV-4: 5-bromo-benzotriazole
Compound IV-5: 5-chloro-benzotriazole
Compound IV-6: 5-nitro-benzotriazole
Compound IV-7: 4-nitro-6-chlorobenzotrizole
Compound IV-8: 5-nitro-6-chlorobenzotriazole A heterocyclinc compound substituted by at least one mercapto group and having at least two azanitrogen atoms in its molecule (to be referred to as a nitrogen-containing heterocyclic compound having a mercapto group hereinafter) will be described below. A heterocyclic ring of such a compound has, in addition to a nitrogen atom, a different type of atom such as an oxygen atom, a sulfur atom, and a selenium atom. A useful compound is a monocyclic 5- or 6-membered heterocyclic compound having at least two azanitrogen atoms or a bicyclic or tricyclic heterocyclic compound in which two or three heterocyclic rings each having at least one azanitrogen atom are condensed and is substituted by a mercapto group on a carbon atom adjacent to azanitrogen.

In the nitrogen-containing heterocyclic compound having a mercapto group which can be used in the present invention, examples of a heterocyclic ring are pyrazole, 1,2,4-triazole, 1,2,3-triazole, 1,3,4-thiaziazole, 1,2,3-thiadiazole, 1,2,4-thiadiazole, 1,2,5-thiadiazole, 1,2,3,4-tetrazole, pyridazine, 1,2,3-triazine, 1,2,4-triazine, 1,3,5-triazine, a ring in which two to three rings described above are condensed, e.g., triazolotriazole, diazaindene, triazaindene, tetrazaindene, and pentazaindene. A heterocyclic ring in which a monocyclic heterocyclic ring and an aromatic ring are condensed, e.g., a phthalazine ring or an indazole ring can be used.

Of these rings, preferable rings are 1,2,4-triazole, 1,3,4-thiadiazole, 1,2,3,4-tetrazole, 1,2,4-triazine, triazolotriazole, and tetrazaindene.

Although a mercapto group may be substituted on any carbon atom of these rings, it is preferable to form the following bonds:

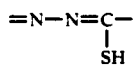

a)

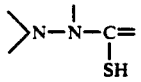

b)

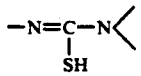

c)

The heterocyclic ring may have substituents other than the mercapto group. Examples of the substituent are an alkyl group having eight or less carbon atoms (e.g., methyl, ethyl, cyclohexyl, and cyclohexylmethyl), a substituted alkyl group (e.g., sulfoethyl and hydroxymethyl), an alkoxy group having eight or less carbon atoms (e.g., methoxy and ethoxy), an alkylthio group having eight or less carbon atoms (methylthio and butylthio), a hydroxyl group, an amino group, a hydroxyamino group, an alkylamino group having eight or less carbon atoms (e.g., methylamino and butylamino), a dialkylamino group having eight or less carbon atoms (e.g., dimethylamino and diisopropylamino), an arylamino group (e.g., anilino), an acylamino group (e.g., acetylamino), a halogen atom (e.g., chlorine and bromine), a cyano group, a carboxyl group, a sulfo group, a sulfato group, and a phospho group.

Examples of the nitrogen-containing heterocyclic compound having a mercapto group for use in the present invention are listed in Table 8 to be presented later. The compound, however, is not limited to those in Table 8.

Although an addition amount of the antifoggant or stabilizer used in the present invention cannot be uniquely determined since it depends on an addition method or an amount of a silver halide, it is preferably $10^{-7}$ to $10^{-2}$ mol, and more preferably $10^{-5}$ to $10^{-2}$ mol per mol of a silver halide.

A silver halide of any of silver bromide, silver iodobromide, silver iodochlorobromide, silver chlorobromide, and silver chloride can be used in a silver halide emulsion of the present invention. A preferable silver halide is silver iodobromide, silver bromide, or silver chlorobromide containing 30 mol% or less of silver iodide.

A silver halide grain to be used in the present invention can be selected from a regular crystal not including a twinning plane and those described in Japan Photographic Society ed., "Silver Salt Photographs, Basis of Photographic Industries", (Corona Co., P. 163) such as a single twined crystal including one twinning plane, a parallel multiple twined crystal including two or more parallel twinning plane, and a non-parallel multiple twined crystal including two or more nonparallel twinning plane in accordance with its application. In the case of a regular crystal, a cubic grain consisting of (100) faces, an octahedral grain consisting of (111) faces, and a dodecahedral grain consisting of (110) faces disclosed in JP-B-55-42737 and JP-A-60-222842 can be used. In addition, a grain consisting of (h11), e.g., (211) faces, a grain consisting of (hh1), e.g., (331) faces, a grain consisting of (hk0), e.g., (210) faces, and a grain consisting of (hk1), e.g., (321) faces as reported in "Journal of Imaging Science", Vol. 30, P. 247, 1986 can be selectively used in accordance with an application although a preparation method must be improved. A grain including two or more types of faces, e.g., a tetradecahedral grain consisting of both (100) and (111) faces, a grain consisting of both (100) and (110) faces, and a grain consisting of both (111) and (110) faces can be selectively used in accordance with an application.

The grain of a silver halide may be a fine grain having a grain size of 0.1 microns or less or a large grain having a projected surface area diameter of 10 microns.

An emulsion of the present invention may be a monodispersed emulsion having a narrow distribution or a polydispersed emulsion having a wide distribution. A so-called monodispersed silver halide emulsion having a narrow size distribution, i.e., in which 80% or more (the number or weight of grains) of all grains fall within the range of ±30% of an average grain size can be suitably used in the present invention.

The photographic emulsions of the present invention can be prepared by using methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating Photographic Emulsion", Focal Press, 1964. That is, the photographic emulsion can be prepared by, e.g., an acid method, a neutralization method, and an ammonia method. Also, as a method for reacting a soluble silver salt and a soluble halide, a single mixing method, a double mixing method, or a combination thereof can be used. Also, a so-called back mixing method for forming silver halide grains in the presence of excessive silver ions can be used. As one mode of the double mixing method, a so-called controlled double jet method wherein the pAg of the liquid phase in which the silver halide is generated is kept at a constant value can be used. According to this method, a silver halide emulsion having grains of a regular crystal form and of almost uniform grain sizes is obtained.

The silver halide emulsion containing the above-described regular silver halide grains can be obtained by controlling the pAg and pH during grain formation. More specifically, such a method is described in "Photographic Science and Engineering", Vol. 6, 159-165 (1962); "Journal of Photographic Science", Vol. 12, 242-251 (1964); U.S. Pat. No. 3,655,394, and British Patent 1,413,748.

A tabular grain having an aspect ratio of 3 or more can also be used in the present invention. The tabular grain can be easily prepared by methods described in, for example, Cleve, "Photography Theory and Practice", (1930), P. 131; Gutoff, "Photographic Science and Engineering", Vol. 14, PP. 248 to 257, (1970); and U.S. Pat. Nos. 4,434,226, 4,414,310, 4,433,048 and 4,439,520 and British Patent 2,112,157. When the tabular grain is used, covering power and a color sensitizing efficiency of a sensitizing dye can be advantageously improved as described in detail in U.S. Pat. No. 4,434,226.

The tabular grains are preferably used in the emulsion of the present invention. In particular, tabular grains in which grains having aspect ratios of 3 to 8 occupy 50% or more of a total projected surface area are preferable.

In the silver halide emulsion of the present invention, a crystal structure of a silver halide grain may be uniform, may have different halogen compositions inside and outside a crystal, or may be layered structure. These emulsion grains are disclosed in, e.g., British Patent 1,027,146, U.S. Pat. Nos. 3,505,068 and 4,444,877, and Japanese Patent Application No. 58-248469. In addition, the silver halide grain may be combined with a silver halide having different compositions by an epitaxial junction, or a compound other than a silver halide such as silver rhodanate or lead oxide.

The silver halide emulsion of the present invention preferably has a distribution or structure with reference to a halogen composition in its grain. A typical example is a core-shell type or double structured grain having different halogen compositions in the interior and surface layer of the grain as disclosed in, e.g., JP-B-43-13162, JP-A-61-215540, JP-A-60-222845, and JP-A-61-75337. In such a grain, the shape of a core portion is sometimes identical to or sometimes different from that of the entire grain with a shell. More specifically, while the core portion is cubic, the grain with a shell is sometimes cubic or sometimes octahedral. On the contrary, while the core portion is octahedral, the grain with a shell is sometimes cubic or sometimes octahedral. In addition, while the core portion is a clear regular grain, the grain with a shell is sometimes slightly deformed or sometimes does not have any definite shape. Furthermore, not a simple double structure but a triple structure as disclosed in JP-A-60-222844 or a multilayered structure having more layers can be formed, or a thin layer of a silver halide having a different composition can be formed on the surface of a core-shell double structure grain.

In order to give a structure inside the grain, a grain having not only the above surrounding structure but a so-called junction structure can be made. Examples of such a grain are disclosed in, e.g., JP-A-59-133540, JP-A-58-108526, EP 199290A2, JP-B-58-24772, and JP-A-59-16254. A crystal, which will form a junction with a host crystal and which has a composition different from that of the host crystal, can be formed on an edge, corner, or face portion of the host crystal. Such a junction crystal can be formed regardless of whether the host crystal has a homogeneous halogen composition or a core-shell structure.

The junction structure can be naturally made by a combination of silver halides. In addition, the junction structure can be made by combining a silver salt compound not having a rock salt structure, e.g., silver rhodanate or silver carbonate with a silver halide. A non-silver salt compound such as PbO can also be used as long as the junction structure can be made.

In a silver iodobromide grain having the above structure, e.g., in a core-shell type grain, the silver iodide content may be high at a core portion and low at a shell portion or vice versa. Similarly, in a grain having the junction structure, the silver iodide content may be high in a host crystal and relatively low in a junction crystal or vice versa.

In a grain having the above structure, a boundary portion between different halogen compositions may be clear or unclear due to a mixed crystal formed by a composition difference. Alternatively, a continuous structure change may be positively made.

The silver halide emulsion of the present invention can be subjected to a treatment for rounding a grain as disclosed in, e.g., EP-0096727Bl and EP-0064412Bl or a treatment of modifying the surface of a grain as disclosed in DE-2306447C2 and JP-A-60-221320.

A silver halide grain for use in the emulsion of the present invention is preferably of a surface latent image type. An internal latent image type grain, however, can be used by selecting a developing solution or development conditions as disclosed in JP-A-59-133542. In addition, a shallow internal latent image type grain covered with a thin shell can be used in accordance with an application.

A silver halide solvent can be effectively used to promote ripening. For example, in a known conventional method, an excessive amount of halogen ions are supplied in a reaction vessel in order to accelerate ripening. Therefore, it is apparent that ripening can be accelerated by only supplying a silver halide solution into a reaction vessel. In addition, another ripening agent can be used. In this case, a total amount of these ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added in separate steps together with a halide and a silver salt.

Examples of the ripening agent other than the halogen ion are ammonium, an amine compound and a thiocyanate such as an alkali metal thiocyanate, especially sodium or potassium thiocyanate and ammonium thiocyanate.

The above various additives are used in the light-sensitive material of the present invention. In addition to the above additives, however, various additives can be used in accordance with applications.

These additives are described in Research Disclosures, Item 17643 (Dec. 1978) and Item 18716 (Nov. 1979) and they are summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23-24 | page 648, right column to page 649, right column |
| 4. Brighteners | page 24 | |
| 5. Antifoggants and stabilizers | pages 24-25<br>pages 24-25 | page 649, right column |
| 6. Light absorbent, filter dye, ultraviolet absorbents | pages 25-26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26-27 | page 650, right column |
| 13. Antistatic agents | page 27 | page 650, right column |

In this invention, various color couplers can be used in the photographic material. Specific examples of these couplers are described in above-described Research Disclosure, No. 17643, VII-C to VII-G as patent references.

Preferred examples of a yellow coupler are described in, e.g., U.S. Pat. Nos. 3,933,501, 4,022,620, 4,326,024, and 4,401,752, JP-B-58-10739, and British Patents 1,425,020 and 1,476,760.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, and U.S. Pat. Nos. 4,500,630 and 4,540,654.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,211, and 4,367,282, and British Patent 2,102,173.

Couplers releasing a photographically useful residue upon coupling are preferably used in the present invention. DIR couplers, i.e., couplers releasing a development inhibitor are described in the patents cited in the above-described Research Disclosure No. 17643, VII-F, JP-A-57-151944, JP-A-57-154234, JP-A-60-184248, and U.S. Pat. No. 4,248,962.

Preferable examples of a coupler imagewise releasing a nucleating agent or a development accelerator upon development are those described in British Patent 2,097,140, 2,131,188, and JP-A-59-157638 and JP-A-59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound or a DIR coupler releasing coupler described in, e.g., JP-A-60-185950 and JP-A-62-24252; couplers releasing a dye which turns to a colored form after being released described in EP 173,302A; bleaching accelerator releasing couplers described in, e.g., RD. Nos. 11449 and 24241 and JP-A-61-201247; and a legand releasing coupler described in, e.g., U.S. Pat. No. 4,553,477.

The couplers for use in this invention can be introduced in the light-sensitive materials by various known dispersion methods.

Examples of a high-boiling solvent used in an oil-in-water dispersion method are described in, e.g., U.S. Pat. No. 2,322,027.

Examples of a high-boiling organic solvent to be used in the oil-in-water dispersion method and having a boiling point of 175° C. or more at normal pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, and bis(1,1-diethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of an impregnating latex are described in, e.g., U.S. Pat. No. 4,199,363 and West German Patent Application (OLS) Nos. 2,541,274 and 2,541,230.

The present invention can be applied to various color light-sensitive materials. Examples of the material are a color negative film for a general purpose or a movie, a color reversal film for a slide or a television, color paper, a color positive film, and color reversal paper.

When the present invention is used for a color photographic material, the present invention can be applied to various light-sensitive materials having a structure and to light-sensitive materials having combinations of a layer structure and special color materials.

Typical examples are: light-sensitive materials in which a coupling speed or diffusibility of a color coupler is combined with a layer structure, as disclosed in, e.g., JP-B-47-49031, JP-B-49-3843, JP-B-50-21248, JP-A-59-58147, JP-A-59-60437, JP-A-60-227256, JP-A-61-4043, JP-A-61-43743, and JP-A-61-42657; light-sensitive materials in which a single color-sensitive layer is divided into two or more layers, as disclosed in JP-B-49-15495 and U.S. Patent 3,843,469; and light-sensitive materials, in which an arrangement of high-and low-sensitivity layers or layers having different color sensitivities is defined, as disclosed in JP-B-53-37017, JP-B-53-37018, JP-A-51-49027, JP-A-52-143016, JP-A-53-97424, JP-A-53-97831, JP-A-62-200350, and JP-A-59-177551.

Examples of a support suitable for use in this invention are described in the above-mentioned RD. No. 17643, page 28 and ibid., No. 18716, page 647, right column to page 648, left column.

The color photographic light-sensitive materials using the photographic emulsion of this invention can be processed by the ordinary processes as described, for example, in the above-described Research Disclosure, No. 17643, pages 28 to 29 and ibid., No. 18716, page 651, left to right columns.

A color developer used in developing of the color photographic light-sensitive material utilizing the photographic emulsion of the present invention is an aqueous alkaline solution mainly consisting of, preferably, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-⊖-methoxyehtylaniline, and sulfates, hydrochlorides and p-toluenesulfonates thereof. These compounds can be used in a combination of two or more thereof in accordance with applications.

In general, the color developer contains a pH buffer such as a carbonate, a borate or a phosphate of an alkali metal, and a development restrainer or antifoggant such as a bromide, an iodide, a benzimidazole, a benzothiazole or a mercapto compound. If necessary, the color developer may also contain a preservative such as hydroxylamine, diehtylhydroxylamine, a hydrazine sulfite, a phenylsemicarbazide, triethanolamine, a catecholsulfonic acid or a triethylenediamine(1,4-diazabicyclo[2,2,2]octane); an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraace-tic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The p of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing the bromide ion concentration in a replenishing solution. In order to decrease the replenishment amount, the contact area of a processing tank with air is preferably decreased to prevent evaporation and oxidation of the solution upon contact with air. The replenishment amount can be decreased by using a means capable of suppressing an accumulation amount of bromide ions in the developer.

A color development time is normally set between 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase the processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the desired applications. Examples of the bleaching agent are a compound of a multivalent metal such as iron (III), cobalt (III), chromium (VI) and copper (II); a peroxide; a quinone; and a nitro compound. Typical examples of the bleaching agent are a ferricyanide; a bichromate; an organic complex salt of iron (III) or cobalt (III), e.g., a complex salt with an aminopolycarboxylic acid such as ethtylenediaminetetraacetic acid, diethtylenetriaminepentaacetic acid, cyclohexanediaminetetraacetic acid, methyliminodiacetic acid, 1,3-diaminopropanetetraacetic acid, and glycoletherdiaminetetraacetic acid, or a complex salt with citric acid, tartaric acid or malic acid; a persulfate; a bromate; a permanganate; and a nitrobenzene. Of these compounds, an iron (III) complex salt with aminopolycarboxylic acid such as an iron (III) complex salt with ethylenediaminetetraacetic acid, and a persulfate are preferred because they can increase a processing speed and prevent the environmental contamination. The iron (III) complex salt with aminopolycarboxylic acid is effective in both the bleaching and bleach-fixing solutions. The pH of the bleaching or bleach-fixing solution using the iron (III) complex salt with aminopolycarboxylic acid is normally 5.5 to 8. In order to increase the processing speed, however, processing can be performed at a lower pH.

A bleaching accelerator can be used in the bleaching solution, the bleach-fixing solution and their pre-bath, if necessary. Effective examples of the bleaching accelerator are compounds having a mercapto group or a disulfide group described in, e.g., U.S. Pat. No. 3,893,858, West German Patents 1,290,812 and 2,059,988, JP-A-53-32,736, JP-A-53-57,831, JP-A-53-37,418, JP-A-53-72,623, JP-A-53-95,630, JP-A-53-95,631, JP-A-53-104,232, JP-A-53-124,424, JP-A-53-141,623, JP-A-53-28,426, and Research Disclosure No. 17,129 (July, 1978); a thiazolidine derivative described in JP-A-50-140,129; thiourea derivatives described in JP-B-45-8,506, JP-A-52-20,832, JP-A-53-32,735, and U.S. Patent 3,706,561; iodides described in West German Patent 1,127,715 and JP-A-58-16,235; polyoxyethylene compounds described in West German Patents 966,410 and 2,748,430; a polyamine compound described in JP-B-45-8836; compounds described in JP-A-49-42,434, JP-A-49-59,644, JP-A-53-94,927, JP-A-54-35,727, JP-A-55-26,506, and JP-A-58-163,940; and a bromide ion. Of these compounds, a compound having a mercapto group or a disulfide group is preferable since the compound has a good accelerating effect. In particular, the compounds described in U.S. Pat. No. 3,893,858, West German Patent 1,290,812, and JP-A-53-95,630. In addition, the compound described in U.S. Pat. No. 4,552,834 is also preferable. These bleaching accelerators may be added in the light-sensitive material. These bleaching accelerators are effective especially in bleach-fixing of a photographic color light-sensitive material.

Examples of the fixing agent are a thiosulfate, a thiocyanate, a thioether-based compound, a thiourea and a large amount of an iodide. Of these compounds, a thiosulfate, especially, ammonium thiosulfate can be used in a widest range of applications. As a preservative of the bleach-fixing solution, a sulfite, a bisulfite or a carbonyl bisulfite adduct is preferred.

The color photographic light-sensitive material using the photographic emulsion of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing mode representing a counter or forward current, and other conditions. The relationship between the amount of water and the number of water tanks in a multi-stage counter-current mode can be obtained by a method described in "Journal of the Society of Motion Picture and Television Engineers", Vol. 64, PP. 248-253 (May, 1955).

According to the above-described multi-stage counter-current mode, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in Japanese Patent Application No. 61-131,632. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bobai Gakkai ed., "Dictionary of Antibacterial and Antifungal Agents".

The pH of the water for washing the color photographic light-sensitive material using the photographic emulsion of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material using the photographic emulsion of the present invention can be processed directly by a stabilizer in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing formalin and a surfactant to be used as a final bath of the photographic color light-sensitive material. Various chelating agents or antifungal agents can be added in the stabilizing bath.

An overflow solution produced upon washing and/or replenishment of the stabilizing solution can be reused in another step such as a desilvering step.

The color photographic light-sensitive material using the photographic emulsion of the present invention may contain a color developing agent in order to simplify processing and increase the processing speed. In order to add the color developing agent, various types of precursors of the color developing agent is preferably used. Examples of the precursor are an indoaniline-based compound described in U.S. Pat. No. 3,342,597, Schiff base compounds described in U.S. Pat. No. 3,342,599, Research Disclosure Nos. 14,850 and 15,159, an aldol compound described in Research Disclosure No. 13,924, a metal salt complex described in U.S. Pat. No. 3,719,492, and an urethane-based compound described in JP-A-53-135,628.

The color photographic light-sensitive material using the photographic emulsion of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a high temperature to shorten a processing time, or image quality or stability of a processing solution may be improved at a lower temperature. In order to save silver for the light-sensitive material, processing using cobalt intensification or hydrogen peroxide intensification described in West German Patent No. 2,226,770 or U.S. Pat. No. 3,674,499 may be performed.

The color photographic light-sensitive material using the photographic emulsion of the present invention can also be applied to thermal development light-sensitive materials described in, e.g., U.S. Pat. No. 4,500,626, JP-A-60-133449, JP-A-59-218443, JP-A-61-238056, and EP 210,660A2. (Examples)

The present invention will be described in detail below by way of its examples. The present invention, however, is not limited to these examples.

EXAMPLE 1

The dependency of selenium sensitization on additoin amount of a palladium compound will be described.

Preparation of Em-A 1,000 ml of an aqueous solution containing 40 g of gelatin and 0.2 g of KBr were strongly stirred at 75° C. 208 ml of an aqueous silver nitrate solution ($AgNO_3$=1.46 g) and 208 ml of an aqueous KBr solution (KBr=1.1 g) were simultaneously added to the stirred solution over 17 minutes. After the silver potential of the reaction solution was adjusted to be −25 mV with respect to a saturated calomel electrode, 471 ml of an aqueous silver nitrate solution ($AgNO_3$=94.2 g) and an aqueous KBr solution (KBr=14.6 wt%) were simultaneously added to the resultant solution over 33 minutes such that an initial flow rate of the aqueous silver nitrate solution was set to be 1 ml/min, its final flow rate was set to be 19 ml/min, and the silver potential of the reaction solution was maintained at −25 mV. After the addition, the resultant solution was ripened for 10 minutes and desalted by a flocculation method. 43 g of gelatin were added to the resultant solution and the pH and the pAg of the solution were adjusted to be 6.6 and 8.0, respectively, at a temperature of 40° C., thereby obtaining 700 g of an emulsion Em-A.

The prepared emulsion contained monodisperse octahedral grains having an average circle-equivalent diameter of 0.60 μm and a variation coefficient of a circle-equivalent diameter of 9%. $2\times10^{-3}$ mol/molAg of potassium thiocyanate and $8\times10^{-6}$ mol/molAg of N,N-dimethylselenourea were added to the above emulsion Em-A, and the resultant emulsion was subjected to chemical sensitization at 60° C. so that maximum sensitivity was obtained under the exposure and development conditions to be described later. 0, $1\times10^{-6}$, $5\times10^{-6}$, $1\times10^{-5}$, $5\times10^{-5}$, $1\times10^{-4}$, $5\times10^{-4}$, and $1\times10^{-3}$ mol/molAg of $(NH_4)_2PdCl_4$ were added to the emulsion before addition of N,N-dimethylselenourea, thereby preparing emulsions Em-A-1, Em-A-2, Em-A-3, Em-A-4, Em-A-5, Em-A-6, Em-A-7, and Em-A-8.

Each of the emulsions Em-A-1 to Em-A-8 and a protective layer were coated in the coating amounts as listed in Table 1 on a cellulose triacetate film support having an undercoated layer.

TABLE 1

| Emulsion Coating Conditions | |
|---|---|
| (1) Emulsion Layer | |
| Emulsion . . . emulsions Em-A-1 to Em-A-8 | (silver $2.1\times10^{-2}$ mol/m$^2$) |
| Coupler | ($1.5\times10^{-3}$ mol/m$^2$) |
| Tricresylphosphate | (1.10 g/m$^2$) |
| Gelatin | (2.30 g/m$^2$) |
| (2) Protective Layer | |
| 2,4-dichloro-6-hydroxy-s-triazine sodium salt | (0.08 g/m$^2$) |
| Gelatin | (1.80 g/m$^2$) |

After these samples were left to stand at a temperature of 40° C. and a relative humidity of 70% for 14 hours, they were exposed for 1/100 sec. through a continuous wedge and subjected to the following color development.

The density of each developed sample was measured by using a green filter.

| Step | Time | Temperature |
|---|---|---|
| Color development | 2 min. 00 sec. | 40° C. |
| Bleach-Fix | 3 min. 00 sec. | 40° C. |
| Washing (1) | 20 sec. | 35° C. |
| Washing (2) | 20 sec. | 35° C. |
| Stabilization | 20 sec. | 35° C. |
| Dry | 50 sec. | 65° C. |

The processing solution compositions will be described below.

| | (g) |
|---|---|
| a) Color Developing Solution | |
| Diethylenetriamine pentaacetate | 2.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 l |
| pH | 10.05 |
| b) Bleach-Fixing Solution | |
| Ferric Ammonium Ethylenediaminetetraacetate (Dihydrate) | 90.0 |
| Disodium Ethylenediaminetetraacetate | 5.0 |
| Sodium Sulfite | 12.0 |
| Aqueous Ammonium Thiosulfate Solution (70%) | 260.0 ml |
| Acetic Acid (98%) | 5.0 ml |
| Bleaching Accelerator | 0.01 mol |

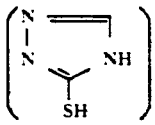

| | |
|---|---|
| Water to make | 1.0 l |
| pH | 6.0 |

(c) Washing Solution

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium ion and magnesium ion to be 3 mg/l or less. Subsequently, 20 mg/l of sodium isocyanurate dichloride and 1.5 g/l of sodium sulfate were added.

The pH of the solution fell within the range of 6.5 to 7.5.

| d) Stabilizer | (g) |
|---|---|
| Formalin (37%) | 2.0 ml |
| Polyoxyethylene-p-monononyl-phenylether (average polymerization degree = 10) | 0.3 |
| Disodium Ethylenediaminetetraacetate | 0.05 |

-continued

| d) Stabilizer | (g) |
|---|---|
| Water to make | 1.0 l |
| pH | 5.0 to 8.0 |

The sensitivity is represented by a relative value of a reciprocal of an exposure amount in lux·sec. for giving a density of 0.2 in fog.

The obtained results are summarized in Table 2.

TABLE 2

Comparison between Sensitivities and Fogs of Em-A-1 to Em-A-8

| Emulsion No. | | Addition Amount of Pd mol/molAg | Relative Sensitivity | Fog |
|---|---|---|---|---|
| Em-A-1 | Comparative Example | 0 | 100 | 0.14 |
| Em-A-2 | Comparative Example | $1 \times 10^{-6}$ | 100 | 0.14 |
| Em-A-3 | Comparative Example | $5 \times 10^{-6}$ | 95 | 0.14 |
| Em-A-4 | Comparative Example | $1 \times 10^{-5}$ | 100 | 0.14 |
| Em-A-5 | Present Invention | $5 \times 10^{-5}$ | 105 | 0.12 |
| Em-A-6 | Present Invention | $1 \times 10^{-4}$ | 110 | 0.10 |
| Em-A-7 | Present Invention | $5 \times 10^{-4}$ | 117 | 0.09 |
| Em-A-8 | Present Invention | $1 \times 10^{-3}$ | 110 | 0.08 |

As is apparent from Table 2, when the addition amount of a palladium compound is $5\times10^{-5}$ mol/molAg or more, and more preferably, $1\times10^{-4}$ mol/molAg or more, fog in selenium sensitization can be reduced with high sensitivity.

EXAMPLE 2

The influence of the timing of addition of a palladium compound on selenium sensitization of an emulsion which is subjected to reduction sensitization during grain formation will be described.

Preparation of Em-B

An equeous solution containing gelatin and KBr was maintained at a temperature of 40° C., and an aqueous silver nitrate solution ($AgNO_3$=32.7 g) and a halogen solution (KBr=24.9 g and KI=1.3 g) were added to the solution under constant stirring over four minutes. After that, the resultant solution was heated to 70° C., and 0.80 mg of thiourea dioxide as a reducing agent were added to the solution. An aqueous silver nitrate solution ($AgNO_3$=152.3 g) and an aqueous halogen solution containing 5.3 wt% of KI with respect to KBr) were then added to the resultant solution over 32.1 minutes. During addition, a silver potential of the solution was maintained at 0 mV with respect to a saturated calomel electrode. Thereafter, an aqueous silver nitrate solution ($AgNO_3$=7.2 g) were added to the solution over 1.5 minutes. The resultant solution was desalted by a flocculation method five minutes after the addition. Gelatin was added to the resultant solution and the pH and the pAg of the solution were adjusted to be 6.9 and 8.0, respectively, at a temperature of 40° C., thereby obtaining an emulsion Em-B. This emulsion contained tabular grains having an average thickness of 0.13 μm, an average circle-equivalent diameter of 0.68 μm, a variation coefficient of a circle-equivalent diameter of 28%, and an aspect ratio of 5.2.

After $1.40\times10^{-3}$ mol/molAg of a sensitizing dye I-14 shown in Table 7 were added to this emulsion Em-B, the emulsion was heated to 72° C. $3.0\times10^{-3}$ mol/molAg of potassium thiocyanate, $6.9\times10^{-6}$ mol/molAg of N,N-dimethylselenourea, and $3.4\times10^{-5}$ mol/molAg of potassium chloroaurate were added to the resultant emulsion, and the emulsion was stirred for 40 minutes. $5\times10^{-4}$ mol/molAg of an antifoggant V-8 shown in Table 8 were then added to the resultant emulsion, and the emulsion was cooled to 40° C. Thereafter, 0, $0.5\times10^{-6}$, and $4\times10^{-4}$ mol/molAg of $K_2PdCl_4$ were added to the resultant emulsion to prepare emulsions Em-B-1, Em-B-2, and Em-B-3, respectively.

$5\times10^{-6}$ and $4\times10^{-4}$ mol/molAg of $K_2PdCl_4$ were added to the emulsion before addition of N,N-dimethylselenourea, thereby preparing emulsions Em-B-4 and Em-B-5, respectively.

$5\times10^{-6}$ and $4\times10^{-4}$ mol/molAg of $K_2PdCl_4$ were added to the emulsion four minutes before the emulsion was desalted by a flocculation method, thereby preparing emulsions Em-B-6 and Em-B-7, respectively.

A coating aid and a film hardener were added to each of the emulsions Em-B-1 to Em-B-7, and each emulsion was coated on a cellulose triacetate film base in an Ag amount of 2 g/m². The coated emulsion was exposed for 1/100 sec. by a tungsten light bulb (color temperature=4,800 K) through a continuous wedge and a gelatin filter (SC-50: available from Fuji Photo Film Co. Ltd.) The exposed emulsion was developed at 20° C. for ten minutes by using the following surface developing solution (MAA-1).

| | |
|---|---|
| Metol | 2.5 g |
| d-ascorbic Acid | 10.0 g |
| Potassium Bromide | 1.0 g |
| Navox | 35.0 g |
| Water to make | 1,000 ml |

The sensitivity of the obtained emulsion is represented by a relative value of a reciprocal of an exposure amount required to obtain an optical density of fog +0.1.

The obtained results are summarized in Table 3.

TABLE 3

Comparison between Sensitivities and Fogs of Em-B-1 to Em-B-7

| Emulsion No. | | Addition Amount of Pd mol/molAg | Addition Timing of Pd | Relative Sensitivity | Fog |
|---|---|---|---|---|---|
| Em-B-1 | Comparative Example | 0 | — | 100 | 0.32 |
| Em-B-2 | Comparative Example | $5\times10^{-6}$ | After Chemical Sensitization | 100 | 0.32 |
| Em-B-3 | Comparative Example | $4\times10^{-4}$ | After Chemical Sensitization | 91 | 0.27 |
| Em-B-4 | Comparative Example | $5\times10^{-6}$ | During Chemical Sensitization | 100 | 0.31 |
| Em-B-5 | Present Invention | $4\times10^{-4}$ | During Chemical Sensitization | 120 | 0.16 |
| Em-B-6 | Comparative Example | $5\times10^{-6}$ | After Grain Formation/-Before Desalting | 95 | 0.24 |
| Em-B-7 | Present Invention | $4\times10^{-4}$ | After Grain Formation/-Before Desalting | 145 | 0.10 |

As is apparent from Table 3, a palladium compound is necessary upon chemical sensitization. Especially when the compound is added after grain formation and before desalting, its effect is remarkable. If an addition amount of the palladium compound is about $5\times10^{-6}$, the effects of the present invention cannot be obtained.

EXAMPLE 3

A comparison between selenium sensitization and sulfur sensitization will be described below.

Preparation of Em-C

Following the same procedures as in Example 1 disclosed in JP-A-63-11928 applied by Mitsuo Saito, tabular silver chloroiodobromide grains containing 5 mol% of chloride and 5 mol% of iodide and having an aspect ratio of 7.0, an average grain thickness of 0.2 μm, a grain diameter of 1.4 μm, and a variation coefficient of a grain diameter of 20% were prepared. Upon ripening in this emulsion preparation, an aqueous solution containing 1.2 mg of thiourea dioxide was added per mol of an silver ion, thereby performing reduction sensitization during grain formation. After a silver nitrate solution was added, $3.0\times10^{-4}$ mol/molAg of $(NH_4)_2PdCl_4$ were added to the resultant emulsion, and the emulsion was ripened for 10 minutes. After desalting, gelatin was added to the resultant emulsion and the pH and the pAg of the emulsion was adjusted to be 5.2 and 8.7, respectively. At a temperature of 60° C., $7\times10^{-4}$ mol/molAg of a sensitizing dye I-7 shown in Table 7, $4\cdot10^{-5}$ mol/molAg of the antifoggant II-1, $2.4\times10^{-5}$ mol/molAg of sodium thiosulfate, $2.0\times10^{-5}$ mol/molAg of chloroauric acid, and $2.4\times10^{-3}$ mol/molAg of potassium thiocyanate were added to the emulsion, and chemical sensitization is optimally performed to prepare an emulsion Em-C-1.

In this case, "chemical sensitization is optimally performed" means that chemical sensitization is performed such that the highest sensitivity is attained after 1-sec. exposure, subsequently to chemical sensitization.

At a temperature of 60° C., $7\times10^{-4}$ mol/molAg of the sensitizing dye I-7, $4\times10^{-5}$ mol/molAg of the antifoggant II-1, $1.4\times10^{-6}$ mol/molAg of N,N-dimethylselenourea, $3.4\times10^{-5}$ mol/molAg of chloroauric acid, and $2.4\times10^{-3}$ mol/molAg of potassium thiocyanate were added to a similarly prepared chemically nonsensitized emulsion, and chemical sensitization was optimally performed to prepare an emulsion Em-C-2.

Layers having the following compositions were sequentially formed on a triacetylcellulose support to form a coated sample.

The emulsion Em-C-1 was used in emulsion layer 2 of sample 301, and the emulsion Em-C-2 was used in emulsion layer 2 of sample 302.

[Lowermost Layer]

Binder: Gelatin 1 g/m²

Fixing Accelerator:

E-1

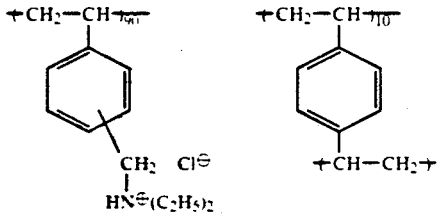

[Emulsion Layer 1: Spherical monodispersed silver iodobromide grains having a circle-equivalent diameter of 0.6 μm, a variation coefficient of 13%, and an iodide content of 3 mol%]

Coating Silver Amount: 1.5 g/m²

Binder: Gelatin 1.6 g/Ag 1 g

Sensitizing Dye:

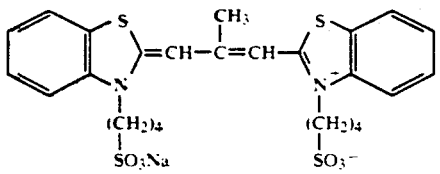

Additive $C_{18}H_{35}O(CH_2CH_2O)_{20}H$ 5.8 mg/Ag 1 g

Coating Aid:

Sodium Dodecylbenzenesulfonate 0.07 mg/m²

Potassium Poly-p-styrenesulfonate 0.7 mg/m²

[Emulsion Layer 2: Emulsion Em-C-1 or Em-C-2]

Coating Silver Amount: 4.0 g/m²

Binder, Additive, and Coating Aid: The same as emulsion layer 1

[Surface Protective Layer]

Binder: Gelatin 0.7 g/m²

Coating Aid:

Sodium N-oleoyl-N-methyltaurate 0.2 mg/m²

Matting Agent:

Polymethylmethacrylate Fine Grains 0.13 mg/m²

(average grain size = 3 μm)

These samples were stored at a temperature of 25° C. and a relative humidity of 65% for seven days after coating. The stored samples were exposed for one second by a tungsten light bulb (color temperature = 2,854 K) through a continuous wedge, developed by a developing solution D-76 at 20° C. for seven minutes, fixed by a fixing solution (FUJIFIX: available from Fuji Photo Film Co. Ltd.), and washed with water and dried.

The sensitivity of the emulsion is represented by a relative value of a reciprocal of an exposure amount required to obtain an optical density of fog +0.1.

In addition, the graininess of each sample was estimated.

After each sample was uniformly exposed with an amount of light for giving a density of 0.2 above fog and developed as described above, RMS graininess was measured by a method described in "The Theory of The Photographic Process", Macmillan, P. 619.

The obtained results are summarized in Table 4.

TABLE 4

Comparison between Sensitivities and Grainnesses of Samples 301 and 302

| Sample No. | | Chemical Sensitization | Relative Sensitivity | Relative Graininess |
|---|---|---|---|---|
| 301 | Comparative Example | Sulfur Sensitization | 100 | 100 |
| 302 | Present Invention | Selenium Sensitization | 146 | 100 |

As is apparent from Table 4, the emulsion according to the present invention, which is subjected to selenium sensitization and gold sensitization in the presence of a palladium compound in an amount of $5\times10^{-5}$ mol or more per mol of a silver halide, has the same graininess as and higher sensitivity than those of the emulsion subjected to sulfur sensitization and gold sensitization in the presence of a palladium compound in an amount of $5\times10^{-5}$ mol or more of a silver halide.

EXAMPLE 4

Effects of the use of a combination of selenium sensitization and sulfur sensitization with respect to a grain having an internal structure with a different halogen composition from those of its surface will be described below.

Preparation of Em-D

Following the same procedures as in Example 1 disclosed in U.S. Pat. No. 4,668,614, internally high iodide type twined crystal silver iodobromide grains having an average iodide content of 14.0 mol% were prepared. The prepared grains had a sphere-equivalent diameter of 1.53 μm, a core/shell ratio of ½, and a core iodide content of 42 mol%.

After desalting, gelatin was added to the emulsion and the pH and the pAg of the emulsion was adjusted to be 6.8 and 8.0, respectively. At a temperature of 55° C., $1.4\times10^{-6}$ mol/molAg of N,N-dimethylselenourea, $1.0\times10^{-6}$ mol/molAg of chloroauric acid, and $1.3\times10^{-3}$ mol/molAg potassium thiocyanate were added to the resultant emulsion, and chemical sensitization was optimally performed to prepare emulsion Em-D-1.

In this case, "chemical sensitization was optimally performed" means that chemical sensitization is performed such that the highest sensitivity is attained after 1/100 sec. exposure, subsequently to chemical sensitization.

An emulsion Em-D-2 was prepared following the same procedures as for the emulsion Em-D-1 except that $1.4\times10^{-6}$ mol/molAg of sodium thiosulfate were added.

An emulsion Em-D-3 was prepared following the same procedures as for the emulsion Em-D-1 except that $1.5\times10^{-4}$ mol/molAg of $(NH_4)_2PdCl_4$ were added immediately before desalting.

An emulsion Em-D-4 was prepared following the same procedures as for the emulsion Em-D-2 except that $1.5\times10^{-4}$ mol/molAg of $(NH_4)_2PdCl_4$ were added immediately before desalting.

Each of samples 401 to 404 as a multilayered color light-sensitive material consisting of layers having the following compositions was formed on an undercoated cellulose triacetate film support.

Compositions of Light-Sensitive Layers

The coating amounts of a silver halide and colloidal silver are represented in g/m$^2$ of silver, and that of sensitizing dyes is represented by the number of mols per mol of the silver halide in the same layer. Note that symbols indicating additives have the following meanings. If an additive has a plurality of effects, only one effect is shown.

UV: Ultraviolet Absorbent, Solv: High Boiling Organic Solvent, W: Coating Aid, H: Film Hardener, ExS: Sensitizing Dye, ExC: Cyan Coupler, ExM: Magenta Coupler, ExY: Yellow Coupler, Cpd: Additive

| | |
|---|---|
| **Layer 1: Antihalation Layer** | |
| Black Colloidal Silver | |
| coating silver amount | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| **Layer 2: Interlayer** | |
| Fine Silver Bromide Grain | |
| (sphere-equivalent diameter = 0.07 μm) | |
| coating silver amount | 0.15 |
| Gelatin | 1.0 |
| Cpd-2 | 0.2 |
| **Layer 3: 1st Red-Sensitive Emulsion Layer** | |
| Silver Iodobromide Emulsion | |
| (AgI = 10.0 mol %, internally high AgI type, | |
| sphere-equivalent diameter = 0.7 μm, | |
| variation coefficient of sphere-equivalent | |
| diameter = 14%, tetradecahedral grain) | |
| coating silver amount | 0.26 |
| Silver Iodobromide Emulsion | |
| (AgI = 4.0 mol %, internally high AgI type, | |
| sphere-equivalent diameter = 0.4 μm, | |
| variation coefficient of sphere-equivalent | |
| diameter = 22%, tetradecahedral grain) | |
| coating silver amount | 0.2 |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExS-4 | $0.3 \times 10^{-4}$ |
| ExC-1 | 0.33 |
| ExC-2 | 0.009 |
| ExC-3 | 0.023 |
| ExC-6 | 0.14 |
| **Layer 4: 2nd Red-Sensitive Emulsion Layer** | |
| Silver Iodobromide Emulsion | |
| (AgI = 16 mol %, internally high AgI type, | |
| sphere-equivalent diameter = 1.0 μm, | |
| variation coefficient of sphere-equivalent | |
| diameter = 25%, tabular grain, | |
| diameter/thickness ratio = 4.0) | |
| coating silver amount | 0.55 |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| **Layer 5: 3rd Red-Sensitive Emulsion Layer** | |
| Silver Iodobromide Emulsion | |
| (AgI = 10.0 mol %, internally high AgI type, | |
| sphere-equivalent diameter = 1.2 μm, | |
| variation coefficient of sphere-equivalent | |
| diameter = 28%, tabular grain, | |
| diameter/thickness ratio = 6.0) | |
| coating silver amount | 0.9 |
| Gelatin | 0.6 |
| ExS-1 | $2 \times 10^{-4}$ |
| ExS-2 | $0.6 \times 10^{-4}$ |

-continued

| | |
|---|---|
| ExS-3 | $0.2 \times 10^{-4}$ |
| ExC-4 | 0.07 |
| ExC-5 | 0.06 |
| Solv-1 | 0.12 |
| Solv-2 | 0.12 |
| **Layer 6: Interlayer** | |
| Gelatin | 1.0 |
| Cpd-4 | 0.1 |
| **Layer 7: 1st Green-Sensitive Emulsion Layer** | |
| Silver Iodobromide Emulsion | |
| (AgI = 10.0 mol %, internally high AgI type, | |
| sphere-equivalent diameter = 0.7 μm, | |
| variation coefficient of sphere-equivalent | |
| diameter = 14%, tetradecahedral grain) | |
| coating silver amount | 0.2 |
| Silver Iodobromide Emulsion | |
| (AgI = 4.0 mol %, internally high AgI type, | |
| sphere-equivalent diameter = 0.4 μm, | |
| variation coefficient of sphere-equivalent | |
| diameter = 22%, tetradecahedral grain) | |
| coating silver amount | 0.1 |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |
| Solv-5 | 0.03 |
| **Layer 8: 2nd Green-Sensitive Emulsion Layer** | |
| Silver Iodobromide Emulsion | |
| (AgI = 10 mol %, internally high iodide type, | |
| sphere-equivalent diameter = 1.0 μm, | |
| variation coefficient of sphere-equivalent | |
| diameter = 25%, tabular grain, | |
| diameter/thickness ratio = 3.0) | |
| coating silver amount | 0.4 |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |
| Solv-5 | 0.03 |
| **Layer 9: Interlayer** | |
| Gelatin | 0.5 |
| **Layer 10: 3rd Green-Sensitive Emulsion Layer** | |
| Silver Iodobromide emulsion | |
| (AgI = 10.0 mol %, internally high AgI type, | |
| sphere-equivalent diameter = 1.2 μm, | |
| variation coefficient of sphere-equivalent | |
| diameter = 28%, tabular grain, | |
| diameter/thickness ratio = 6.0) | |
| coating silver amount | 1.0 |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |
| **Layer 11: Yellow Filter Layer** | |
| Cpd-3 | 0.05 |
| Gelatin | 0.5 |
| Solv-1 | 0.1 |
| **Layer 12: Interlayer** | |
| Gelatin | 0.5 |
| Cpd-2 | 0.1 |
| **Layer 13: 1st Blue-Sensitive Emulsion Layer** | |
| Silver Iodobromide Emulsion | |
| (AgI = 10 mol %, internally high iodide type, | |
| sphere-equivalent diameter = 0.7 μm, | |
| variation coefficient of sphere-equivalent | |
| diameter = 14%, tetradecahedral grain) | |
| coating silver amount | 0.1 |
| Silver Iodobromide Emulsion | |
| (AgI = 4.0 mol %, internally high iodide type, | |

-continued

| | |
|---|---|
| sphere-equivalent diameter = 0.4 μm, variation coefficient of sphere-equivalent diameter = 22%, tetradecahedral grain) | |
| coating silver amount | 0.05 |
| Gelatin | 1.0 |
| ExS-8 | $3 \times 10^{-4}$ |
| ExY-1 | 0.53 |
| ExY-2 | 0.02 |
| Solv-1 | 0.15 |
| **Layer 14: 2nd Blue-Sensitive Emulsion Layer** | |
| Silver Iodobromide Emulsion (AgI = 19.0 mol %, internally high AgI type, sphere-equivalent diameter = 1.0 μm, variation coefficient of sphere-equivalent diameter = 16%, tetradecahedral grain) | |
| coating silver amount | 0.19 |
| Gelatin | 0.3 |
| ExS-8 | $2 \times 10^{-4}$ |
| ExY-1 | 0.22 |
| Solv-1 | 0.07 |
| **Layer 15: Interlayer** | |
| Fine Silver Iodobromide Grain (AgI = 2 mol %, homogeneous type, sphere-equivalent diameter = 0.13 μm) | |
| coating silver amount | 0.2 |
| Gelatin | 0.36 |
| **Layer 16: 3rd Blue-Sensitive Emulsion Layer** | |
| Em-D-1, Em-D-2, Em-D-3, or Em-D-4 | |
| coating silver amount | 1.0 |
| Gelatin | 0.5 |
| ExS-8 | $1.5 \times 10^{-4}$ |
| ExY-1 | 0.2 |
| Solv-4 | 0.07 |
| **Layer 17: 1st Protective Layer** | |
| Gelatin | 1.8 |
| UV-1 | 0.1 |
| UV-2 | 0.2 |
| Solv-1 | 0.01 |
| Solv-2 | 0.01 |
| **Layer 18: 2nd Protective Layer** | |
| Fine Silver Bromide Grain (sphere-equivalent diameter = 0.07 μm) | |
| coating silver amount | 0.18 |
| Gelatin | 0.7 |
| Polymethylmethacrylate Grain (diameter = 1.5 μm) | 0.2 |
| W-1 | 0.02 |
| H-1 | 0.4 |
| Cpd-5 | 1.0 |

Formulas of the used compounds are listed in Table 9. The emulsions Em-D-1, Em-D-2, Em-D-3, and Em-D-4 were used in the layer 16 to form samples 401, 402, 403, and 404, respectively.

The color photographic light-sensitive materials 401 to 404 as described above were exposed and developed (until an accumulated replenishing amount of a bleaching solution became three times a capacity of a mother solution tank) by using an automatic developing machine in accordance with the following method.

Processing Method

| Process | Time | Temperature | Replenishing* Amount | Tank Volume |
|---|---|---|---|---|
| Color Development | 3 min. 15 sec. | 38° C. | 15 ml | 20 l |
| Bleaching | 6 min. 30 sec. | 38° C. | 10 ml | 40 l |
| Washing | 2 min. 10 sec. | 35° C. | 10 ml | 20 l |
| Fixing | 4 min. 20 sec. | 38° C. | 20 ml | 30 l |
| Washing (1) | 1 min. 05 sec. | 35° C. | Counter flow piping from (2) to (1) | 10 l |
| Washing (2) | 1 min. 00 sec. | 35° C. | 20 ml | 10 l |
| Stabilization | 1 min. 05 sec. | 38° C. | 10 ml | 10 l |
| Drying | 4 min. 20 sec. | 55° C. | | |

*An amount per meter of a 35-mm wide sample

The compositions of the process solutions will be presented below

| | Mother Solution (g) | Replenishing Solution (g) |
|---|---|---|
| **Color Developing Solution:** | | |
| Diethylenetriamine-pentaacetic Acid | 1.0 | 1.1 |
| 1-hydroxyethylidene-1,1-diphosphonic Acid | 3.0 | 3.2 |
| Sodium Sulfite | 4.0 | 4.9 |
| Potassium Carbonate | 30.0 | 30.0 |
| Potassium Bromide | 1.4 | — |
| Potassium Iodide | 1.5 mg | — |
| Hydroxylamine Sulfate | 2.4 | 3.6 |
| 4-(N-ethyl-N-β-hydroxylethylamino)-2-methylaniline Sulfate | 4.5 | 7.2 |
| Water to make | 1.0 l | 1.0 l |
| pH | 10.05 | 10.10 |
| **Bleaching Solution:** | | |
| Ferric Sodium Ethylenediamine-tetraacetate Trihydrate | 100.0 | 140.0 |
| Disodium Ethylene-diaminetetraacetate | 10.0 | 11.0 |
| Ammonium Bromide | 140.0 | 180.0 |
| Ammonium Nitrate | 30.0 | 40.0 |
| Ammonia Water (27%) | 6.5 ml | 2.5 ml |
| Water to make | 1.0 l | 1.0 l |
| pH | 6.0 | 5.5 |
| **Fixing Solution:** | | |
| Disodium Ethylene-diaminetetraacetate | 0.5 | 1.0 |
| Sodium Sulfite | 7.0 | 12.0 |
| Sodium Bisulfite | 5.0 | 9.5 |
| Aqueous Ammonium Thiosulfate Solution (70%) | 170.0 ml | 240.0 ml |
| Water to make | 1.0 l | 1.0 l |
| pH | 6.7 | 6.6 |
| **Washing Solution: Common for mother and replenishing solutions** | | |
| Tap water was supplied to a mixed-bed column filled with an H type strongly acidic cation exchange regin (Amberlite IR-120B: available from Rohm & Haas Co.) and an OH type strongly basic anion exchange resin (Amberlite IR-400) to set calcium and magnesium ion concentrations to be 3 mg/l or less. Subsequently, 20 mg/l of sodium isocyanurate dichloride and 1.5 g/l of sodium sulfate were added. The pH of the solution fell within the range of 6.5 to 7.5. | | |
| **Stabilizing Solution:** | | |
| Formalin (37%) | 2.0 ml | 3.0 ml |
| Polyoxyehtylene-p-monononylphenylether (avearage polymerization degree = 10) | 0.3 | 0.45 |
| Disodium Ethylene-diaminetetraacetate | 0.05 | 0.08 |
| Water to make | 1.0 l | 1.0 l |
| pH | 5.0–8.0 | 5.0–8.0 |

The fogging density and the sensitivity represented by a relative value of a reciprocal of an exposure amount for giving a density higher than fogging density by 1.0 with respect to a characteristic curve of a yellow image is determined. The obtained results are summarized in Table 5.

TABLE 5

| Sample No. | | Comparison of Sensitivity and Fog of Samples 401 to 406: Addition Amount of Pd mol/molAg | Chemical Sensitization | Relative Sensitivity | Fog |
|---|---|---|---|---|---|
| 401 | Comparative Example | 0 | Selenium Sensitization | 100 | 0.21 |
| 402 | Comparative Example | 0 | Selenium and Sulfur Sensitization | 105 | 0.18 |
| 403 | Present Invention | $1.5 \times 10^{-4}$ | Selenium Sensitization | 120 | 0.14 |
| 404 | Present Invention | $1.5 \times 10^{-4}$ | Selenium and Sulfur Sensitization | 126 | 0.12 |

As is apparent from Table 5, the present invention is also effective to grains having an internal structure with a different halogen composition from those of its surface. In addition, the effects of the present invention are remarkable when sulfur sensitization is performed in combination with selenium sensitization.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

TABLE 6

(a)

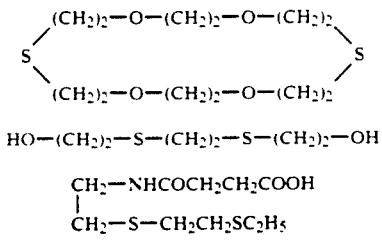

(b)

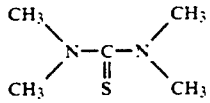

(c)

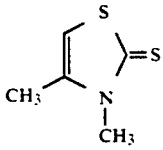

(d)

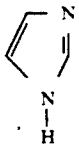

(e) $K_2SO_3$ (f) $NH_4SCN$, KSCN

TABLE 7

I-1

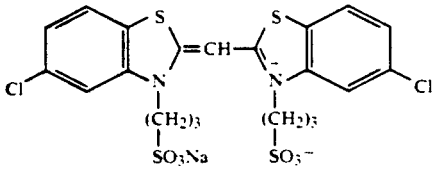

I-2

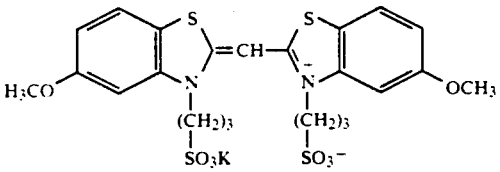

I-3

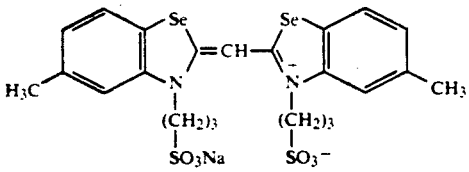

I-4

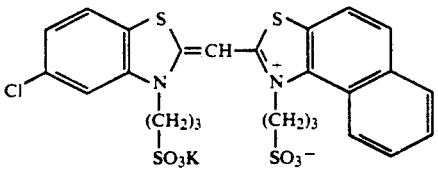

I-5

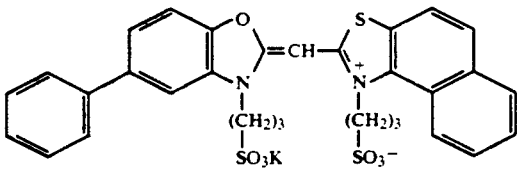

I-6

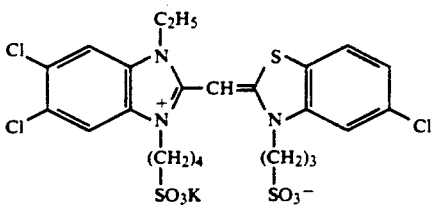

I-7

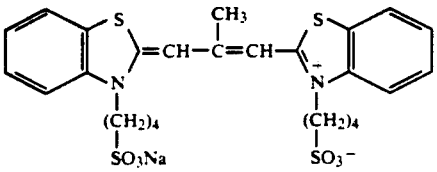

I-8

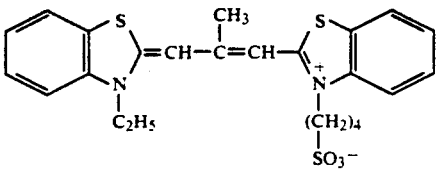

TABLE 7-continued
I-9
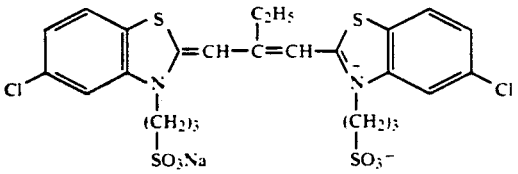
I-10
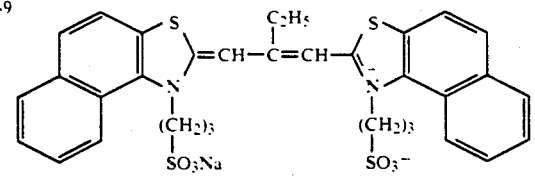
I-11
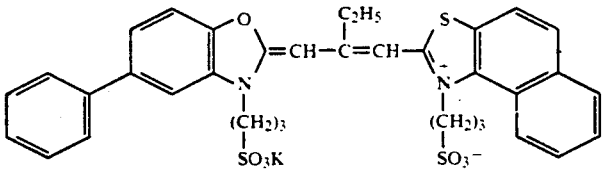
I-12
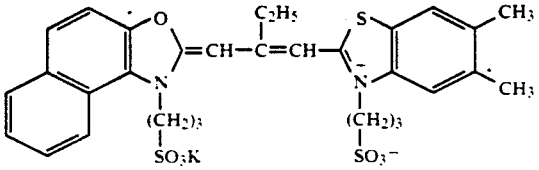
I-13
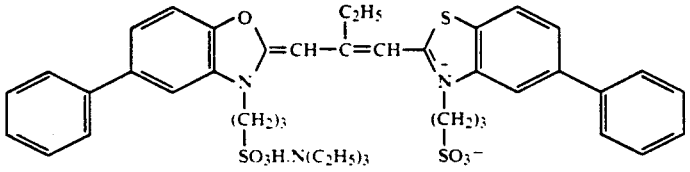
I-14
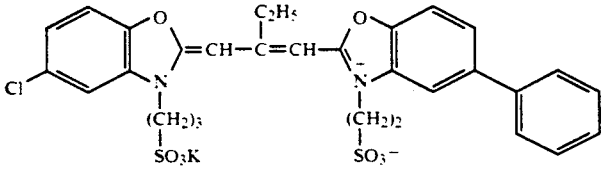
I-15
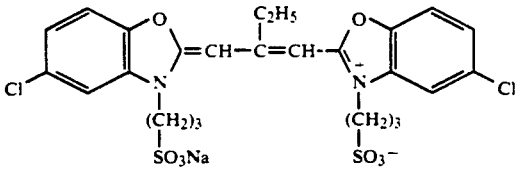
I-16
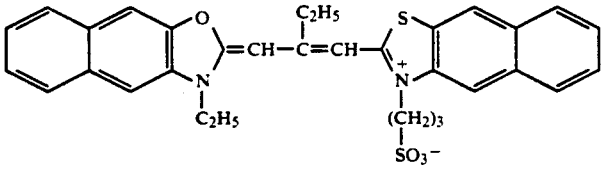
I-17
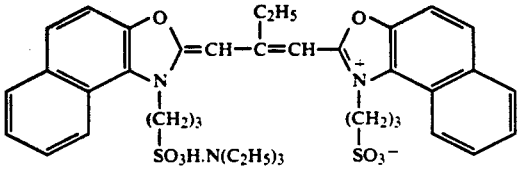
I-18
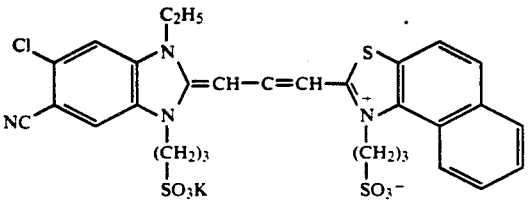

TABLE 7-continued
I-19
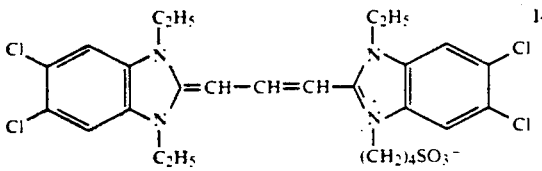
I-20
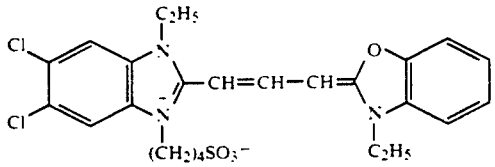
I-21
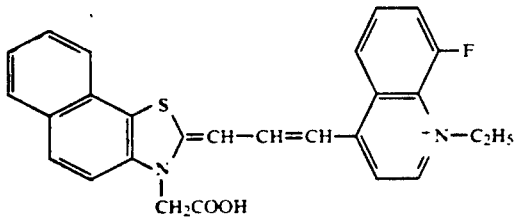
I-22
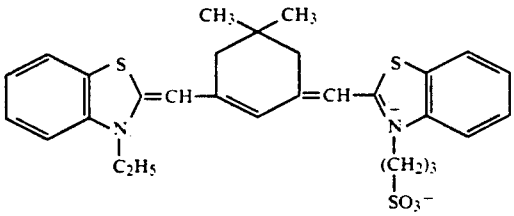
I-23
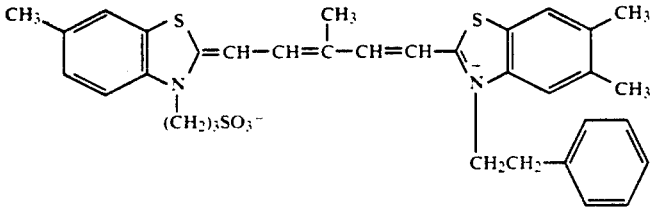
I-24
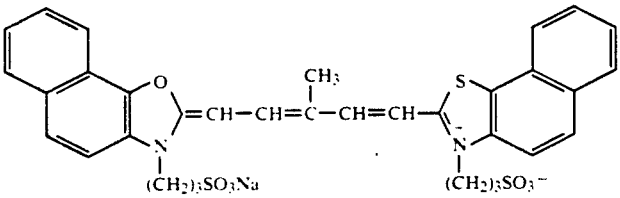
I-25
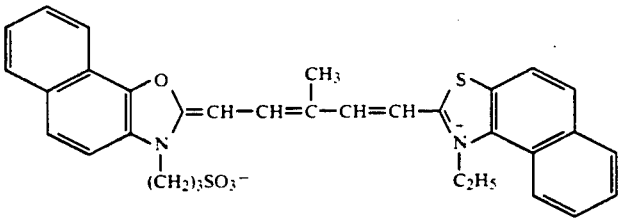
I-26
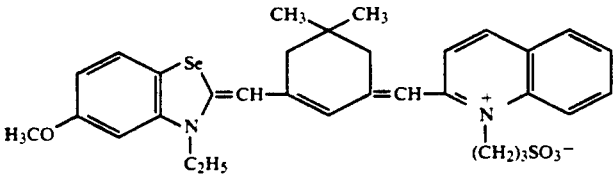
I-27
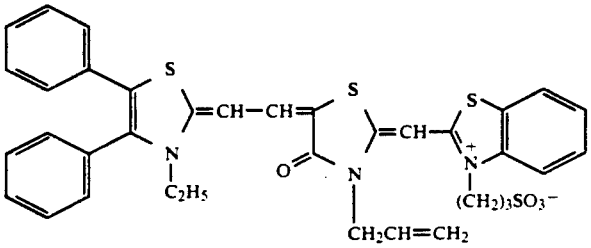

TABLE 7-continued
I-28
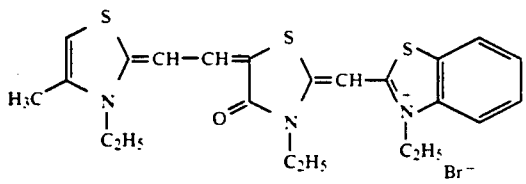
I-29
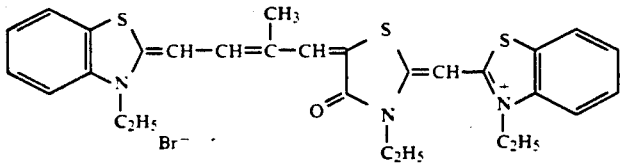
I-30
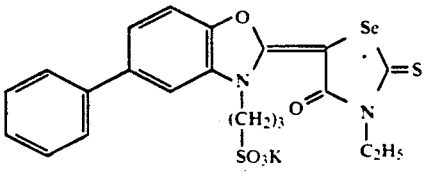
I-31
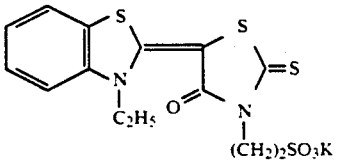
I-32
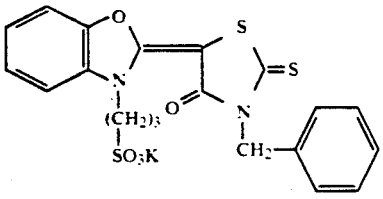
I-33
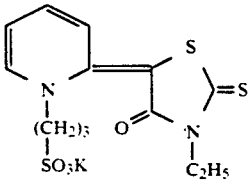
I-34
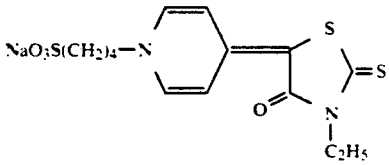
I-35
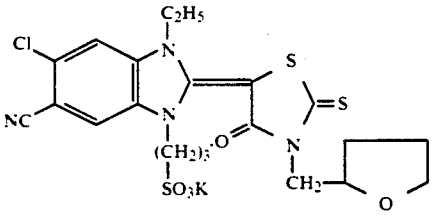
I-36
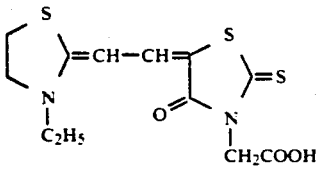
I-37
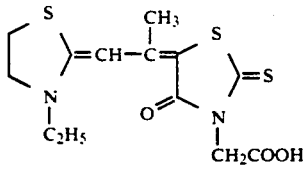
I-38
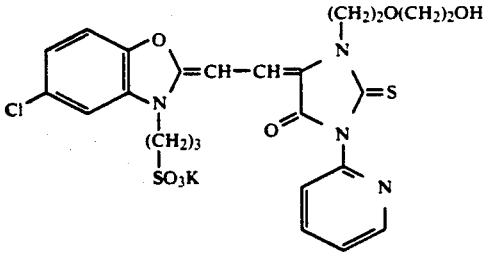
I-39
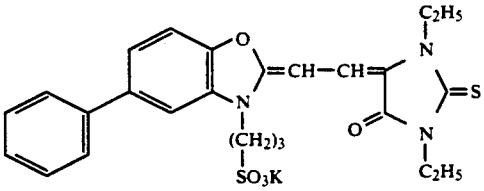
I-40
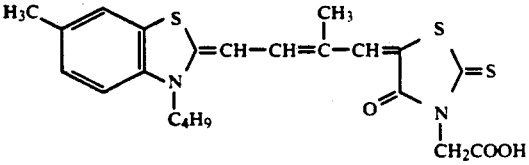
I-41
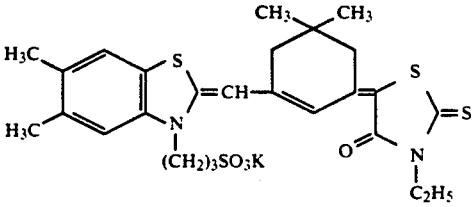

TABLE 7-continued
I-42
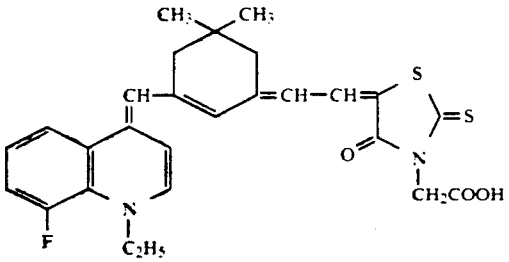
I-43
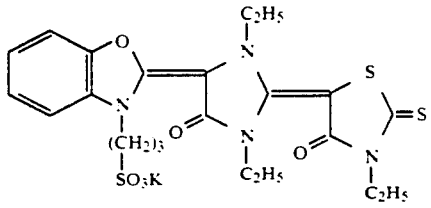
I-44
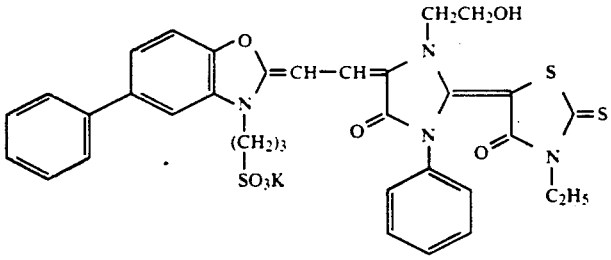
I-45
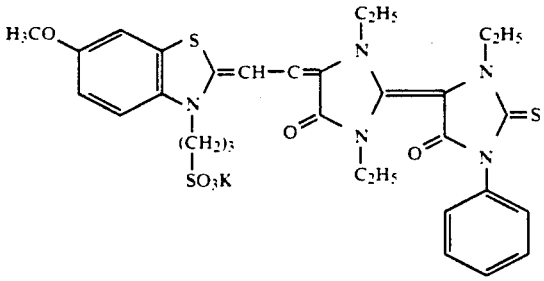
TABLE 8
V-1
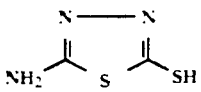
V-2
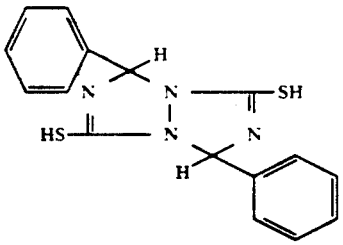
V-3
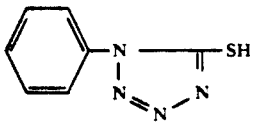
V-4
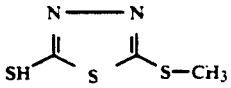
-continued
TABLE 8
V-5
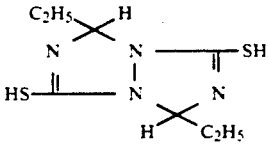
V-6
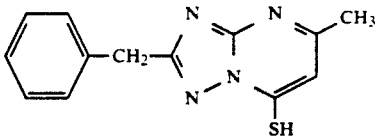
V-7
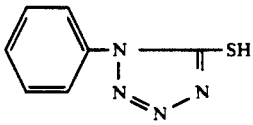
V-8
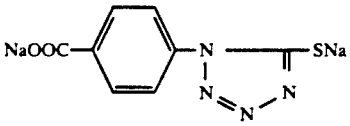
TABLE 9
UV-1 UV-2

TABLE 9-continued
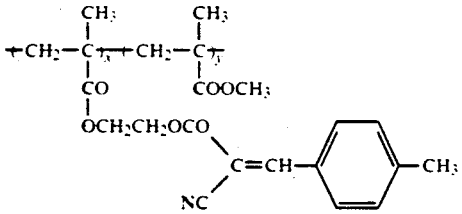
x/y = 7/3 weight ratio
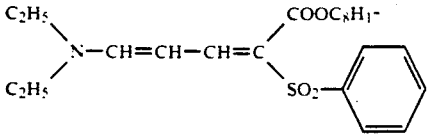
ExC-1
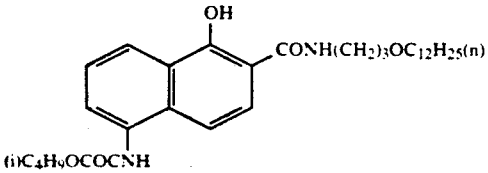
ExC-2
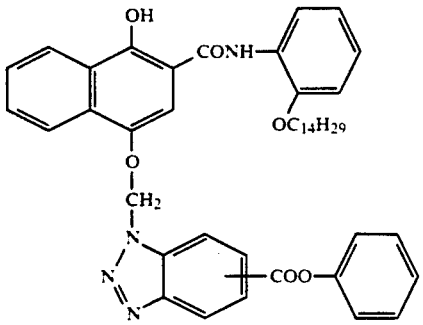
ExC-3
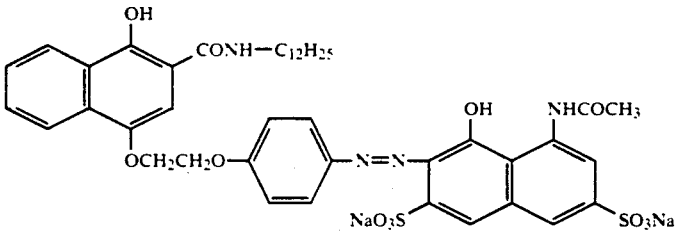
ExC-4
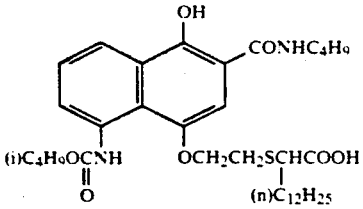
ExC-5
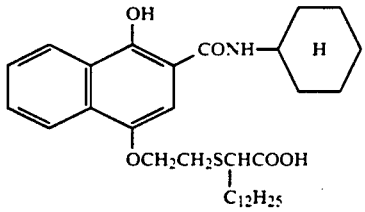
ExC-6
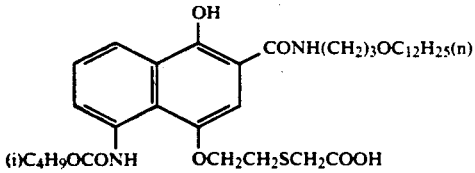
ExM-1
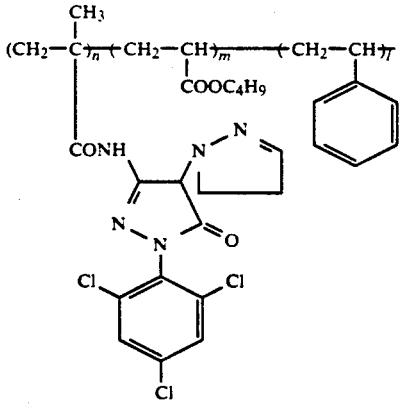
n:m:l = 2:1:1
(weight ratio)
average molecular weight
40,000
ExM-2

TABLE 9-continued
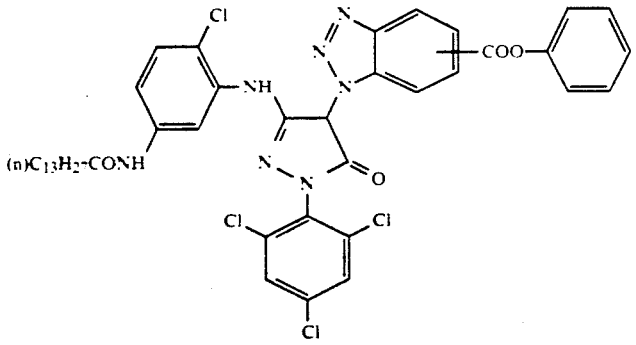
ExM-3
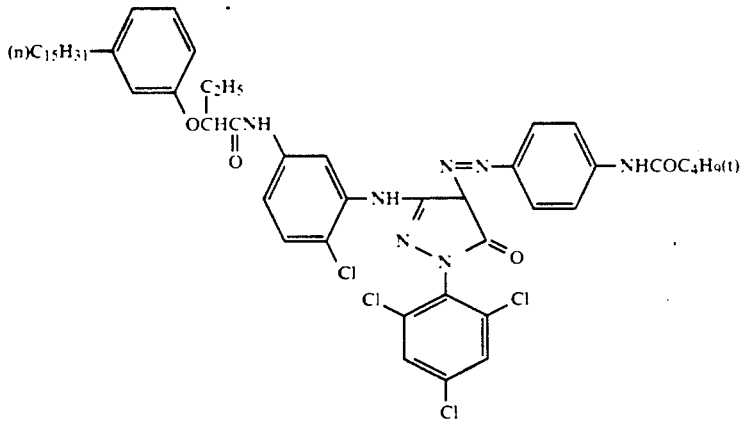
ExM-4
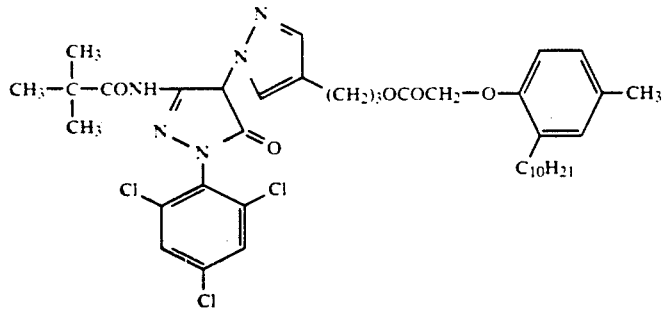
ExM-5
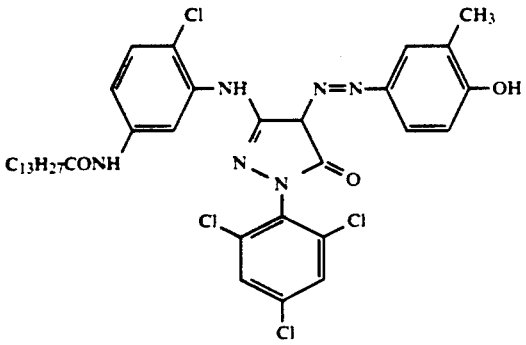
ExY-1
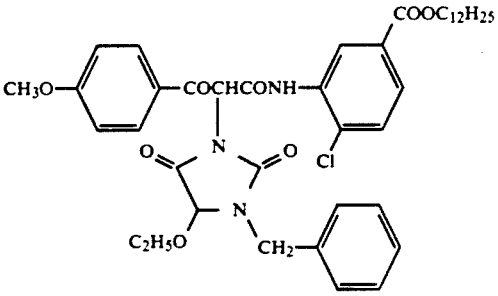
ExY-2

TABLE 9-continued
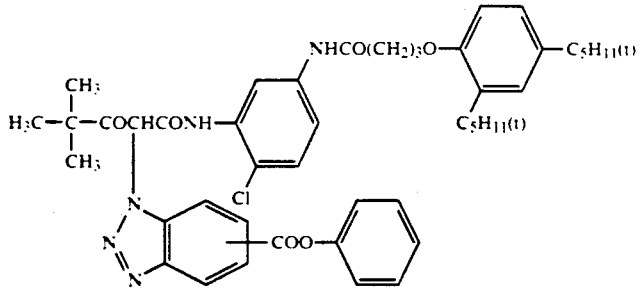
ExS-1
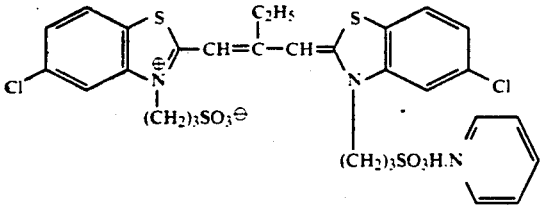
ExS-2
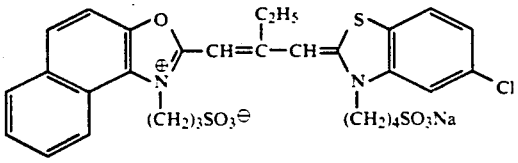
ExS-3
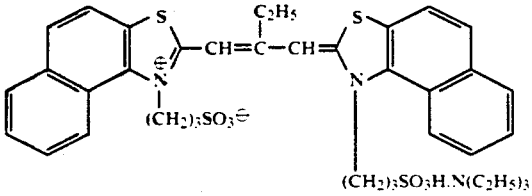
ExS-4
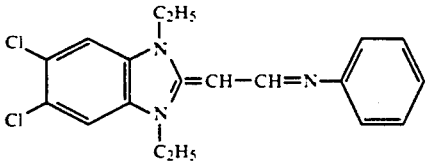
ExS-5
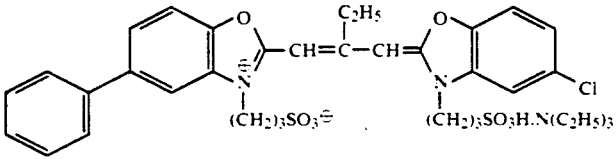
ExS-6
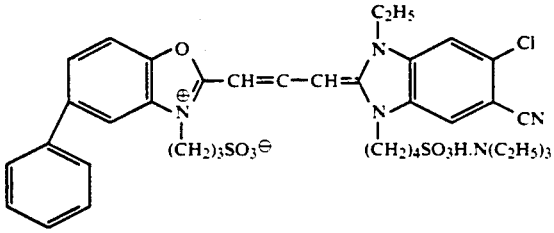
ExS-7
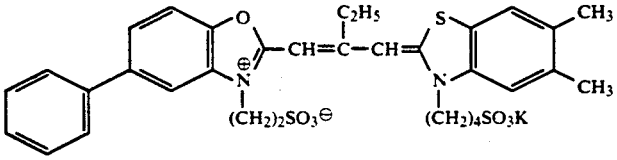
ExS-8
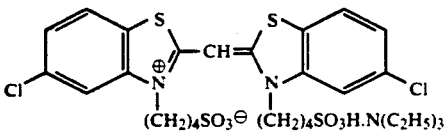
Solv-1
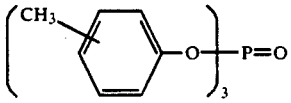
Solv-2
Solv-3

TABLE 9-continued

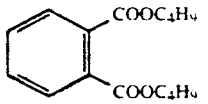

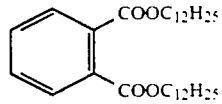

Solv-4

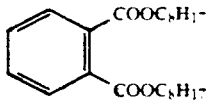

Solv-5

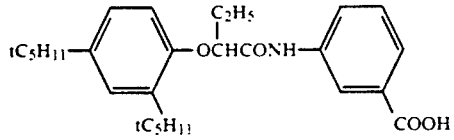

Cpd-1

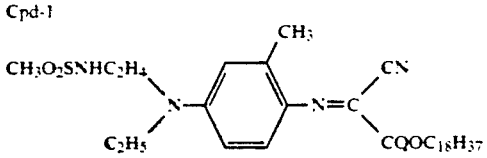

Cpd-2

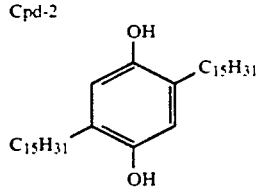

Cpd-3

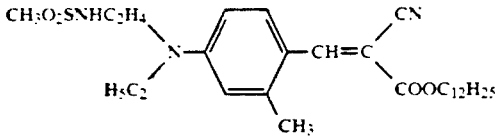

Cpd-4

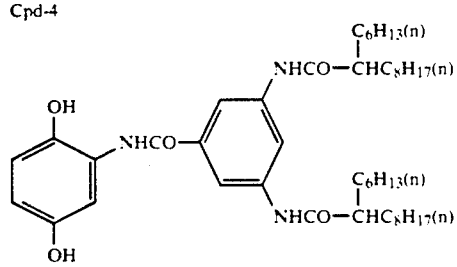

Cpd-5

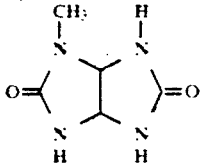

W-1

$C_8F_{17}SO_2NHCH_2CH_2CH_2OCH_2CH_2N^{\oplus}(CH_3)_3$

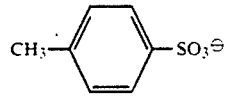

H-1

$CH_2{=}CHSO_2CH_2CONH{-}CH_2$ $CH_2{=}CHSO_2CH_2CONH{-}CH_2$

What is claimed is:

1. A silver halide photographic emulsion subjected to selenium sensitization in the presence of a palladium compound in an amount of not less than $1\times10^{-4}$ mol per mol of a silver halide, wherein said palladium compound is added after grain formation and before desalting.

2. The emulsion according to claim 1, wherein said emulsion is subjected to reduction sensitization during grain formation.

3. The emulsion according to claim 1, wherein said emulsion is subjected to selenium sensitization in the presence of said palladium and thiocyanate ions having a molar ratio of not less than 5 with respect to said palladium compound.

4. A silver halide photographic emulsion subjected to selenium sensitization and sulfur sensitization in the presence of a palladium compound in an amount of not less than $1\times10^{-4}$ mol per mol of a silver halide, wherein said palladium compound is added after grain formation and before desalting.

5. A silver halide photographic emulsion subjected to selenium sensitization and gold sensitization in the presence of a palladium compound in an amount of not less than $1\times10^{-4}$ mol per mol of a silver halide, wherein said palladium compound is added after grain formation and before desalting.

6. A silver halide photographic emulsion subjected to selenium sensitization, sulfur sensitization, and gold sensitization in the presence of a palladium compound in an amount of not less than $1\times10^{-4}$ mol per mol of a silver halide, wherein said palladium compound is added after grain formation and before desalting.

7. The emulsion according to claim 6, wherein the palladium compound is present in an amount of not less than $1\times10^{-4}$ to $5\times10^{-3}$ mol per mol of silver halide.

8. The emulsion according to claim 6, wherein the palladium compound is a palladium divalent or tetravelent salt.

9. The emulsion according to claim 6, wherein the palladium compound is represented by $R_2PdX_6$ or $R_2PdX_4$ wherein R represents a hydrogen atom, an alkali metal atom, or an ammonium group, and X represents a halogen atom.

10. The emulsion according to claim 6, wherein the palladium compound is selected from the group consisting of $K_2PdCl_4$, $(NH_4)PdCl_6$, $Na_2PdCl_4$, $(NH_4)_2PdCl_4$, $Li_2PdCl_4$, $Na_2PdCl_6K_2PdBr_4$, $PdCl_2PdBr_2$, PdI2, $Pd(NO_3)_2$, $PdSO_4$, $Pd(OH)_2$, PdO, $Pd(NH_3)_4Cl_2$, $Pd(NH_3)_4(NO_3)_2$, $PdCl_2(NH_3)_2$, $Pd(NO_2)_2(NH_3)_2$, $Na_2Pd(NO_2)_4$, $K_2Pd(CN)_4$, $K_2Pd(NO_2)_2SO_4$, $Pd(CH_3COO)_2$, $Pd(C_2H_5COO)_2$, $Pd(C_6H_5COO)_2$, $PdCl_2(C_6H_5CN)_2$, $PdCl_2(C_8H_{12})$, $PdI_2(C_7H_8)$, $PdCl_2(PPh_3)_2$, $PdCl_2(C_3H_5)_2$, $Pd(acac)_2$, $Pd(C_{17}H_{34}O)_2$, $Pd(CH_3COO)_2(PPh_3)_2$, and $Pd(PPh_3)_4$.

11. The emulsion according to claim 10, wherein the palladium compound is a water-soluble palladium compound.

12. The emulsion according to claim 6, wherein the palladium compound is present in combination with thiocyanate ions in an amount (mol) five times or more than that of the palladium compound.

* * * * *